US008874439B2

(12) United States Patent
Kim et al.

(10) Patent No.: US 8,874,439 B2
(45) Date of Patent: Oct. 28, 2014

(54) SYSTEMS AND METHODS FOR BLIND SOURCE SIGNAL SEPARATION

(75) Inventors: Taesu Kim, Seoul (KR); Te-Won Lee, San Diego, CA (US)

(73) Assignee: The Regents of the University of California, Oakland, CA (US)

( * ) Notice: Subject to any disclaimer, the term of this patent is extended or adjusted under 35 U.S.C. 154(b) by 1570 days.

(21) Appl. No.: 12/281,298

(22) PCT Filed: Mar. 1, 2006

(86) PCT No.: PCT/US2006/007496

§ 371 (c)(1),
(2), (4) Date: Nov. 21, 2008

(87) PCT Pub. No.: WO2007/100330

PCT Pub. Date: Sep. 7, 2007

(65) Prior Publication Data

US 2009/0222262 A1 Sep. 3, 2009

(51) Int. Cl.
*G10L 21/02* (2013.01)
*G10L 21/0272* (2013.01)
*G10L 25/84* (2013.01)

(52) U.S. Cl.
CPC ..... *G10L 21/0272* (2013.01); *G10L 25/84* (2013.01)
USPC ..... 704/233; 704/226; 704/203; 706/20

(58) Field of Classification Search
None
See application file for complete search history.

(56) References Cited

U.S. PATENT DOCUMENTS 5,706,402 A * 1/1998 Bell ..... 706/22
6,167,417 A * 12/2000 Parra et al. ..... 708/405
6,424,960 B1 * 7/2002 Lee et al. ..... 706/20
6,430,528 B1 8/2002 Jourjine et al.
6,526,148 B1 2/2003 Jourjine et al.
6,654,719 B1 * 11/2003 Papadias ..... 704/233
7,711,553 B2 * 5/2010 Nam ..... 704/201
2001/0037195 A1 * 11/2001 Acero et al. ..... 704/200
2002/0193130 A1 * 12/2002 Yang et al. ..... 455/501
2004/0230428 A1 * 11/2004 Choi ..... 704/226
2005/0060142 A1 * 3/2005 Visser et al. ..... 704/201
2006/0031067 A1 * 2/2006 Kaminuma ..... 704/226

(Continued)

OTHER PUBLICATIONS

Sawada et al. "A Robust and Precise Method for Solving the Permutation Problem of Frequency-Domain Blind Source Separation", IEEE Transactions on Speech and Audio Processing, vol. 12, No. 5, Sep. 2004.*

(Continued)

*Primary Examiner* — Jialong He
(74) *Attorney, Agent, or Firm* — Perkins Coie LLP

(57) ABSTRACT

Signal separation techniques based on frequency dependency are described. In one implementation, a blind signal separation process is provided that avoids the permutation problem of previous signal separation processes. In the process, two or more signal sources are provided, with each signal source having recognized frequency dependencies. The process uses these inter-frequency dependencies to more robustly separate the source signals. The process receives a set of mixed signal input signals, and samples each input signal using a rolling window process. The sampled data is transformed into the frequency domain, which provides channel inputs to the inter-frequency dependent separation process. Since frequency dependencies have been defined for each source, the process is able to use the frequency dependency to more accurately separate the signals. The process can use a learning algorithm that preserves frequency dependencies within each source signal, and can remove dependencies between or among the signal sources.

25 Claims, 10 Drawing Sheets

(56) References Cited

U.S. PATENT DOCUMENTS

| | | | | |
|---|---|---|---|---|
| 2006/0053002 | A1* | 3/2006 | Visser et al. | 704/200 |
| 2006/0206315 | A1* | 9/2006 | Hiroe et al. | 704/203 |
| 2007/0021958 | A1* | 1/2007 | Visser et al. | 704/226 |

OTHER PUBLICATIONS

Jun. et al. "Removing electroencephalographic artifacts by blind source separation", Psychophysiology, 37 ~2000!, 163-178. Cambridge University Press, 2000.*
Lee et al. "Indepnent component analysis using an Extended infomax algorithm for Mixed Sub-Gaussian and Super-Gaussian source", Neural Computation, 1999.*
Choi et al. , "Blind Source Separation and Independent Component Analysis: A Review", Neural Information Processing, vol. 6, No. 1, Jan. 2005.*
Buchner et al. "A Generalization of Blind Source Separation Algorithms for Convolutive Mixtures Based on Second-Order Statistics", IEEE Transactions on Speech and Audio Processing, vol. 13, No. 1, Jan. 2005.*
Allen, J.B. and D. A. Berkley, "Image method for efficiently simulating small room acoustics," J. Acoust. Soc. Amer., 65(4): 943-950 (Apr. 1979).
Amari, S. et al., "A new learning algorithm for blind signal separation," in Advances in Neural Information Processing Systems 8, Proceedings of the 1995 Conference, Touretzky, D.S. et al. (Eds.), MIT Press: Cambridge, Massachusetts, pp. 757-763 (1996).
Anemüller, J. and B. Kollmeier, "Amplitude modulation decorrelation for convolutive blind source separation," Proceedings of the Second International Workshop on Independent Component Analysis and Blind Signal Separation, Helsinki, Finland, Jun. 19-22, 2000, pp. 215-220.
Asano, F. et al., "A combined approach of array processing and independent component analysis for blind separation of acoustic signals," in Proc. IEEE Int. Conf. on Acoustics, Speech, and Signal Processing, pp. 2729-2732 (2001).
Cardoso, J.-F. , "Multidimensional independent component analysis," in Proc. IEEE Int. Conf. on Acoustics, Speech, and Signal Processing, pp. 1941-1944 (1998).
Hyvärinen, A. et al., "Topographic independent component analysis," Neural Computation, 13(7): 1527-1558 (2001).
Hyvärinen, A. and P. Hoyer, "Emergence of phase- and shift- invariant features by decomposition of natural images into independent feature subspaces," Neural Computation, 12(7): 1705-1720 (2000).
Ikram, M.Z. and D. R. Morgan, "A beamforming approach to permutation alignment for multichannel frequency-domain blind speech separation," in Proc. IEEE Int. Conf. on Acoustics, Speech, and Signal Processing, 2002, pp. I-881-I-884.
Karklin, Y. and M. S. Lewicki, "Learning higher-order structures in natural images," Network: Computation in Neural Systems, 14(3): 483-499 (2003).
Kurita, S., "Evaluation of blind signal separation method using directivity pattern under reverberant conditions," in Proc. IEEE Int. Conf. on Acoustics, Speech, and Signal Processing, 2000, pp. 3140-3143.
Lee, T.-W. and M. S. Lewicki, "Unsupervised image classification, segmentation, and enhancement using ICA mixture models," IEEE Transactions on Image Processing, 11(3): 270-279 (Mar. 2002).
Lee, T.-W. et al., "ICA mixture models for unsupervised classification of non-Gaussian classes and automatic context switching in blind signal separation," 22(10): 1078-1089 (Oct. 2000).
Lee, T.-W. et al., "Blind separation of delayed and convolved sources," Advances in Neural Information Processing Systems 9, pp. 758-764 (1997).
Matsuoka, K. and S. Nakashima, "Minimal distortion principle for blind source separation," Proc. Int. Conf. on Independent Component Analysis and Blind Source Separation, 2001, pp. 722-727.
Murata, N. S. et al. , "An approach to blind source separation based on temporal structure of speech signals," Neurocomputing, 41: 1-24, (2001).
Park, H.-J. and T.-W. Lee, "Unsupervised learning of nonlinear dependencies in natural images," Int. J. Imaging Syst. Technol. 15: 34-47 (2005).
Parra, L. and C. Spence, "Convolutive blind separation of non-stationary sources," IEEE Transactions on Speech and Audio Processing, 8(3): 320-327, (2000).
Sawada, H. R. et al., "A robust and precise method for solving the permutation problem of frequency-domain blind source separation," Proceedings of the $4^{th}$ International Symposium on Independent Component Analysis and Blind Signal Separation (ICA2003), Apr. 1-4, 2003, Nara, Japan, pp. 505-510 (2003).
Smaragdis, P., "Blind separation of convolved mixtures in the frequency domain," Neurocomputing, 22:21-34, 1998.
Torkkola, K., "Blind separation of delayed sources based on information maximization," Proc. IEEE Int. Workshop on Neural Networks for Signal Processing, pp. 3509-3512 (1996).
Yellin, D. and E. Weinstein, "Multichannel signal separation: methods and analysis," IEEE Transactions on Signal Processing 44(1): 106-118 (Jan. 1996).

* cited by examiner

SYSTEMS AND METHODS FOR BLIND SOURCE SIGNAL SEPARATION

CROSS-REFERENCE TO RELATED PATENT APPLICATIONS

This application is a national stage application of and claims the benefit of PCT/US06/07496 filed on Mar. 1, 2006, now WO 2007/100330. The disclosure of the prior application is considered part of (and is incorporated by reference in) the disclosure of this application.

BACKGROUND

This application relates to signal processing and systems and methods for separation of source signals using a blind signal separation process.

In recent years, new technologies have brought to light problems with non-linearity, uncertainty, noise and cross channel mixing, compounded by the very limited knowledge available about the data production mechanisms. To deal with recovering original source signals from observed signals without knowing the mixing process, so called blind source separation (BSS), has attracted attention in the field. These signal sources may be, for example, acoustic sources, spectral sources, image sources, data sources, or physiology or medical sources. Part of the allure of BSS is that it has many practical uses, including, but not limited to, communication such as speech enhancement for robust speech recognition, multimedia such as crosstalk separation in telecommunication, use in high-quality hearing aid equipment, analysis of biological/physiological signals such as electrocardiograph (EKG), magnetic resonance (MRI/MRS), electroencephalographs (EEG) and magnetoencephalographs (MEG), data/sensor fusion, and the like. A fundamental requirement for conventional BSS application is that the source signals should be statistically independent. BSS also requires multiple sensors, transducers, or microphones to capture the signals. In many cases, for each independent source, an additional sensor is required. For example, a BSS speech separation process for separating two independent signal sources will require at least two microphones.

One form of BSS is Independent component analysis (ICA). ICA is a conventional method used to separate statistically independent sources from mixtures of sources by utilizing higher-order statistics. The application of ICA to independent signal sources is well known, and has been document, for example, in T.-W. Lee, *Independent Component Analysis: Theory and Applications*. Boston: Kluwer Academic Publishers, 1998. In its simplest form, the ICA model assumes linear, instantaneous mixing without sensor noise, and the number of sources are equal to the number of sensors. However, when trying to solve the problem of separating acoustic source signals mixed in an environment, those assumptions may not be applicable, and are thus not valid, and model extensions are needed. In this way, the application of standard ICA to real-world signal environments is prone to errors, and may require substantial post processing to adequately separate signals.

In one typical application, ICA may be applied to separate signal sources in a broad range of directions spanning areas of signal processing, neural networks, machine learning, data/sensor fusion and communication, including for example, to separate a person's speech from a noise source. In such a real-world environment, the acoustic signal sources are not instantaneous mixtures of the sources, but convolutive mixtures, which means that they are mixed with time delays and convolutions. Accordingly, the conventional ICA assumptions are not present, and the resulting signal separation may be unsatisfactory. In order to deal with such convolved mixtures, the ICA model formulation and the learning algorithm have been extended to convolutive mixtures in both the time and the frequency domains. These extensions have been discussed, for example, in T.-W. Lee, A. J. Bell, and R. Lambert, *Blind separation of convolved and delayed sources, Adv. Neural Information Processing Systems,* 1997, pp. 758-764. Those models are known as solutions to the multichannel blind deconvolution problem. In case of the time domain approach, solutions usually require intensive computations with long de-reverberation filters, and the resulting unmixed source signals are whitened due to the i.i.d. assumption. Slow convergence speed, especially for colored input signals such as speech signals, have been observed, and therefore may not prove effective or practical in real acoustic environments. The computational load and slow convergence can be overcome by the frequency domain approach, in which multiplication at each frequency bin replaces convolution operation in the time domain. Thus, the ICA algorithm may be applied to instantaneous mixtures in each frequency bin.

Although this may be attractive from a computational standpoint, this process can suffer from a permutation problem and other technical difficulties. Permutation results from a failure of the ICA process to place one source in a determined set of frequency bins. That is, any bin may hold a frequency component from any one of the signal sources. Accordingly, when the bins are used to generate a resulting time domain signal, the resulting signal may have certain frequency components from an incorrect source. Hence, a significant problem is the permutation of the ICA solutions over different frequency bins due to the indetermination of permutation inherent in the ICA algorithm. To address this, the process would need to correct the permutations of separating matrices at each frequency so that the separated signal in the time domain is reconstructed properly. Several solutions have been proposed to solve this permutation problem, but none has proven satisfactory in practical application.

Various approaches have been proposed to solve the permutation problem. One known approach is to impose a smoothness constraint of the source that translates into smoothing the separating filter. This approach has been realized by several techniques such as averaging separating matrices with adjacent frequencies (see, P. Smaragdis, *Blind separation of convolved mixtures in the frequency domain, Neurocomputing*, vol. 22), limiting the filter length in the time domain (see, L. Parra and C. Spence, *Convolutive blind separation of non-stationary sources*, vol. 8, no. 3, pp. 320-327, 2000), or considering the coherency of separating matrices at adjacent frequencies (see, F. Asano, S. Ikeda, M. Ogawa, H. Asoh, and N. Kitawaki, *A combined approach of array processing and independent component analysis for blind separation of acoustic signals, in Proc. IEEE Int. Conf. on Acoustics, Speech, and Signal Processing,* 2001, pp. 2729-2732.)

Another known approach is based on direction of arrival (DOA) estimation which is much used in array signal processing. By analyzing the directivity patterns formed by a separating matrix, source directions can be estimated and therefore permutations can be aligned. Such a process is more fully described in S. Kurita, H. Saruwatari, S. Kajita, K. Takeda, and F. Itakura, *Evaluation of blind signal separation method using directivity pattern under reverberant conditions, in Proc. IEEE Int. Conf. on Acoustics, Speech, and Signal Processing,* 2000, pp. 3140-3143. When the sources are colored signals, it is possible to employ the inter-frequency correlations of signal envelopes to align permutations, as described, for example, in J. Anemuller and B. Kollmeier, *Amplitude modulation decorrelation for convolutive blind source separation, in Proc. Int. Conf. on Independent Component Analysis and Blind Source Separation,* 2000, pp. 215-220. These methods may perform well under certain specific conditions but may have degraded performance under different conditions. Moreover, in the case of an ill-posed problem, e.g., the case that each mixing filter of the source is similar, the sources are located close to each other, or DOA of the sources are similar, various methods developed so far fail to separate the source signals.

Thus, there is a need for robust and versatile techniques to separate components from observed signals into various desired components.

SUMMARY

This application provides, among other features, implementations of a blind signal separation process that can be used to avoid the substantial permutation problem of others signal separation processes. In one implementation, a signal separation method is described to include sampling a first input signal, which is a mixture of different signals comprising signals from at least a first signal source and a separate, second signal source, to obtain first frequency components in the first input signal. A second input signal, which is a mixture of different signals comprising signals from at least the first signal source and the second signal source, is also sampled to obtain second frequency components in the second input signal. Next, the first frequency components and the second frequency components are processed to extract frequency dependency information between the first and the second input signals. The extracted frequency dependency information is then used to separate a signal originated from the first signal source from a signal originated from the second signal source.

In the above method, the processing of the first frequency components and the second frequency components can include: identifying first frequency dependency between the first frequency components and the first frequency components that is related to the first signal source;

identifying second frequency dependency between the first frequency components and the first frequency components that is related to the second signal source; using the first frequency dependency to separate a first set of selected frequency components from the first frequency components and the first frequency components; using the second frequency dependency to separate a second set of selected frequency components from the first frequency components and the first frequency components; processing the first set of selected frequency components to generate the signal originated from the first signal source; and processing the second set of selected frequency components to generate the signal originated from the second signal source.

In another implementation, two or more signal sources are provided, with each signal source having recognized frequency dependencies. The blind signal separation process uses these inter-frequency dependencies to more robustly separate the source signals. The separation process receives a set of mixed signal input signals, and samples each input signal using a rolling window process. The sampled data is transformed into the frequency domain, which provides channel inputs to the inter-frequency dependent separation process. Since frequency dependencies have been defined for each source, the inter-frequency dependent separation process is able to use the frequency dependency to more accurately separate the signals. In one example, the inter-frequency dependent separation process uses a learning algorithm that preserves frequency dependencies within each source signal, and allows for removal of any dependencies between or among the signal sources.

Among various applications, the present inter-frequency dependent separation process can be used in an acoustic device, such as a wireless handset or headset, where two microphones that each receives a mixed acoustic signal comprising a speech signal from a target speaker. Each of the mixed signals is transformed to the frequency domain, which is used as a channel input to an inter-frequency dependent separation process. The inter-frequency dependent separation process adapts or learns according to frequency dependencies within a signal source. In this way, the inter-frequency dependent separation process exploits frequency dependencies to more accurately separate the target speech signal from other acoustic sources.

In yet another implementation, a method is described to include transforming multiple mixed signals into respective sets of frequency domain data, each mixed signal being a mixture of a plurality of signal sources; receiving each of the frequency domain data sets as an input to a frequency dependent separation process; adapting the frequency dependent separation process using a multivariate score function; and generating a separated signal.

This application further describes a signal separation process including the following operations: receiving a plurality of mixed input signals, each mixed signal being a mixture of a plurality of signal sources;

sampling each mixed input signal using a respective rolling sampling window; transforming signal data in each current sampling window to frequency domain data sets; receiving the frequency domain data sets as inputs to the inter-frequency dependent separation process; operating an inter-frequency dependent separation process, identifying each component of the frequency domain data according to its correct signal source; and generating a separated signal for at least one of the signal sources. The inter-frequency dependent separation process includes adapting a learning algorithm using an inter-frequency dependency.

These and other implementations, associated features and computer program products which are encoded on a computer-readable medium and are operable to cause data processing apparatus to perform operations of the described signal processing techniques are described in greater detail in the attached drawings, the detailed description and the claims.

DETAILED DESCRIPTION

Figure 1:
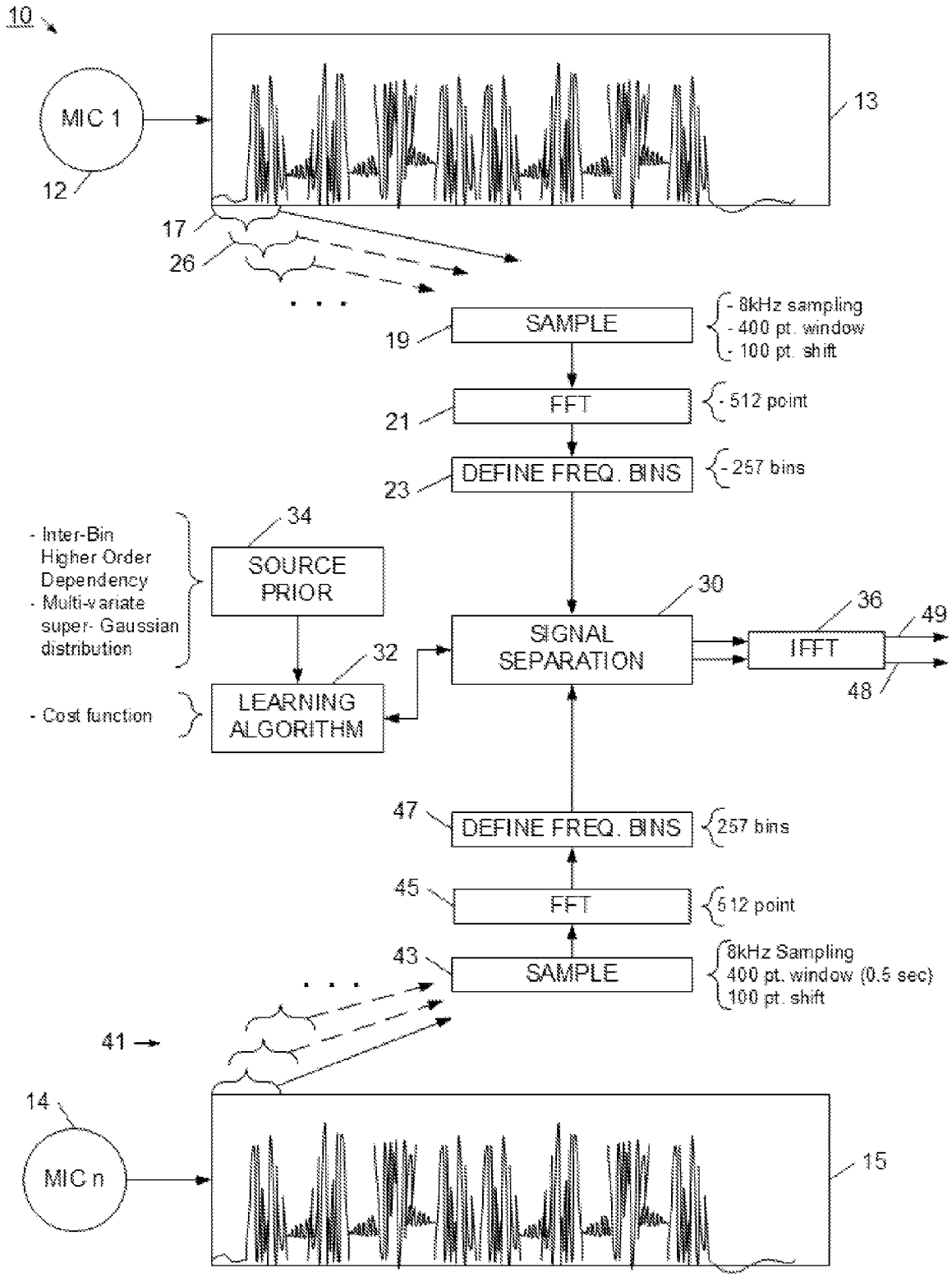
FIG. 1 is a block diagram of an inter-frequency dependent separation system in one implementation.

Referring now to FIG. 1, a blind signal separation process 10 is illustrated. Process 10 is advantageously used to separate dependent signal sources using a blind signal separation process. Even in real-life noisy environments, signal separation process 10 may robustly and confidently separate dependent source signals with a greater degree of accuracy as compared to known ICA processes. Although process 10 will be described with reference to acoustic speech signals, it will be appreciated that other types of source signals may be used. For example, the signal source may be other types of acoustic signals, or may be electronic signals in the form of spectral data, medical data, or physiological data. Process 10 has multiple microphones, such as microphone one 12 and microphone two 14. Although only two microphones are illustrated, it will be understood that additional microphones or other transducers may be used. Each microphone receives a different mixture of signals from at least two signal sources. Since the microphones operate in a real-life environment, the received signals will be convolutive signals that contain time-delay signals and reverberations. The mixed signal for each microphone is digitized, for example using an analog to digital converter, thereby generating a digitized signal 13. In one example, the source signal is an acoustic speech signal, and is adequately digitized at a 8 kHz sampling rate. It will be appreciated that other sampling rates may be used for other types of signals.

A sampling window 17 is defined for the digitized signal data 13. In one example, the sampling window 17 is 400 points long. The 400 point window is received as a sample 19 into a fast Fourier transfer process 21. The fast Fourier transform processes the time domain data into discrete frequency bins 23. Each frequency bin represents a component of frequency in the mixed signal. In one example, the fast Fourier transform is performed as a 512 point transfer, which results in 257 distinct frequency bins. It will be appreciated that the number of points in the fast Fourier transform may be adjusted according to the specific types of signals to be separated. It will also be appreciated that the robustness of the fast Fourier transform, the size of the sample, and other algorithmic processes may be adjusted according to processor or application requirements. For example, additional points may be used when sufficient processing power is available, or other transformation algorithms may be used.

The process of sampling the time domain data 13 can be continually repeated using a moving or rolling sample window. For example, a next sample window 26 may be taken which is offset from the first sample window 17. In one example, the offset may be shifted 100 sample points. It will be appreciated that the shift may be adjusted according to the types of signals to be separated, available processor power, and other application-specific requirements. In this way, a new sample is collected every 100 points, with the sample being converted to the frequency domain for further processing. In a similar manner, microphone two 14 collects time domain data 15. Time domain data 15 also has shifting sample windows 41 which provide sample data 43 which drives a fast Fourier transform 45 for generating frequency domain data in frequency bins 47. Accordingly, both microphone one 12 and microphone two 14 are used to collect time domain data, and the time domain data from each microphone is independently used to load a set of frequency bins. An inter-frequency dependent separation process 30 operates on frequency bins 23 and 47. More particularly, inter-frequency dependent separation process 30 is a frequency dependent component analysis separation process.

The inter-frequency dependent separation process 30 can operate in a manner that exploits higher order frequency dependencies in the source signals. More particularly, the signal separation process 30 expressly defines expected dependencies between frequency bins, and is thereby able to avoid the permutation problem previously described. By using these expected frequency dependencies, the separation process 30 is able to more readily identify the source to which a particular frequency bin is associated. In constructing the signal separation process 30 to recognize such frequency dependencies, it is first desirable to define a source prior 34 that defines the expected dependencies in the source signals. This is, to a certain extent, in contrast to various ICA processes, which operate under the assumption that frequency bins are independent. In defining the dependency using source prior 34, it will be appreciated that alternative definitions may be used. For example, the source prior may be adjusted according to the particular type of signals to be separated, processing power available, or other environmental or application requirements. However, once it is recognized that an inter-bin higher order dependency exists, then a particular source prior 34 may be defined through experimentation or algorithmic processes. For the case when the signal sources are acoustic speech signals, it has been found that a multi-variant super Gaussian distribution appropriately defines dependencies between frequencies. Using such a source prior, higher order dependencies and structures of frequencies are preserved, and the permutation problem is substantially avoided in many circumstances.

In addition to defining an appropriate source prior, the separation system 10 also defines a new cost function for the learning function 32. More particularly, the cost function is selected to particularly deal with the multi-variant characteristics of the source signals. The cost function is selected to maintain dependencies between components of each vector from a source, and also to allow removal of dependency between separate sources. In this way, the inherent frequency dependencies are preserved for each source, which enable the signal separation process 30 to advantageously utilize the frequency dependencies to solve the permutation problem. The signal separation process 30 thereby uses the frequency domain frequency bins as input to the signal separation process, and generates separated signal outputs. The signal outputs are received into an inverse fast Fourier transform process 36, which generates separated time domain signals 48 and 49. Signal separation process 30 cooperates with the learning algorithm 32 to adapt according to the actual signal sources.

Figure 2:
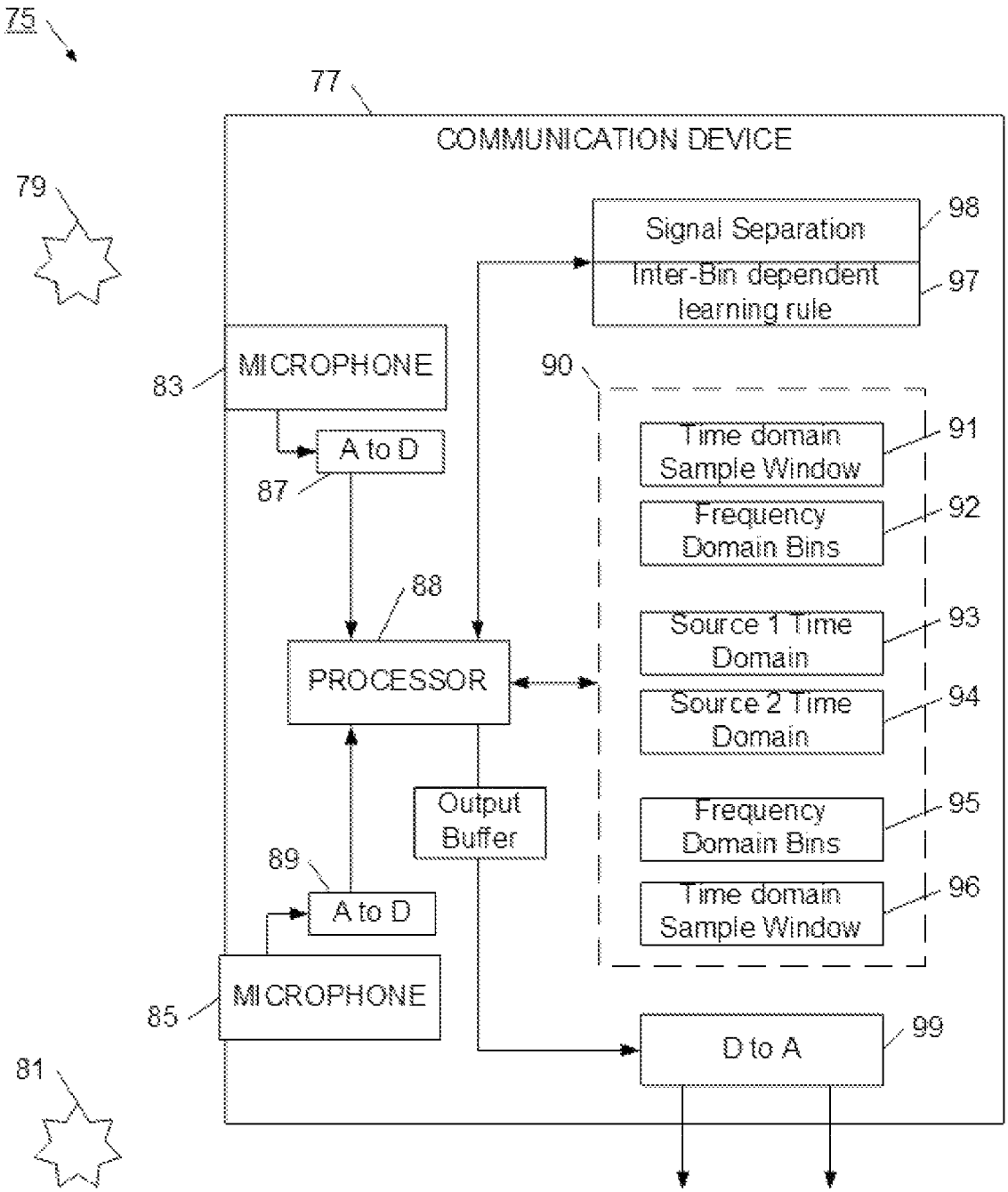
FIG. 2 is a block diagram of a communication device implementing the inter-frequency dependent separation system in FIG. 1.

Referring now to FIG. 2, a communication system 75 is illustrated. Communication system 75 advantageously operates an inter-frequency dependent separation process, such as described with reference to blind signal separation process 10 of FIG. 1. Communication device 77 has at least two microphones, such as microphone 83 and microphone 85 for collecting signals from the signal sources 79 and 81. Although two microphones are illustrated, it will be understood that additional microphones may be used to support particular separation requirements. Since communication device 77 operates in a real environment, each microphone will collect a mixture of signals from the sources, as well as reverberations and other signal and room delays. In this way, each microphone receives a convolutive mixture. Each signal is digitized in its respective analog-to-digital converter 87 and 89. The data is accepted by processor 88, which may temporarily store the digitized time domain data 93 and 94 in its memory 90. The processor operates continual sampling windows 91 and 96, which collect samples into sample windows and performs a fast Fourier transform. The results from the fast Fourier transform are used to generate frequency bins 92 and 95 from each microphone. The processor operates a signal separation process 98 using the frequency bins 92 and 95 as inputs. The signal separation process 98 has an inter-bin dependent learning rule 97, which defines a frequency dependency between bins. Using this inter-bin dependency, the signal separation process 98 is able to more accurately and robustly separate the frequency domain bins according to the correct source assignment. In this way, the processor 88 is able to implement a signal separation process that avoids permutation problems in many situations.

After the signals have been separated, the processor passes the separated frequency domain data to an inverse fast Fourier transform, which converts the frequency domain signals back to the time domain. The time domain data is then passed through a digital to analog converter 99 and the time domain separated signals are available for use, for example, as input to a communication process or speaker. In one example, the communication process is part of voice circuit, and transmits the separated signal on an output line. In this way, separated signals may be transmitted from a phone, public address system, or headset. Alternatively, the communication device may pass the separated signal or signals to a radio for wireless transmission.

It will be appreciated that communication device 77 may be, for example, a wireless headset, a headset, a phone, a mobile phone, a portable digital assistant, a hands-free car kit, or other communication device. It will also be appreciated that the communication device may be used for commercial, industrial, residential, military, or government applications.

Figure 3:
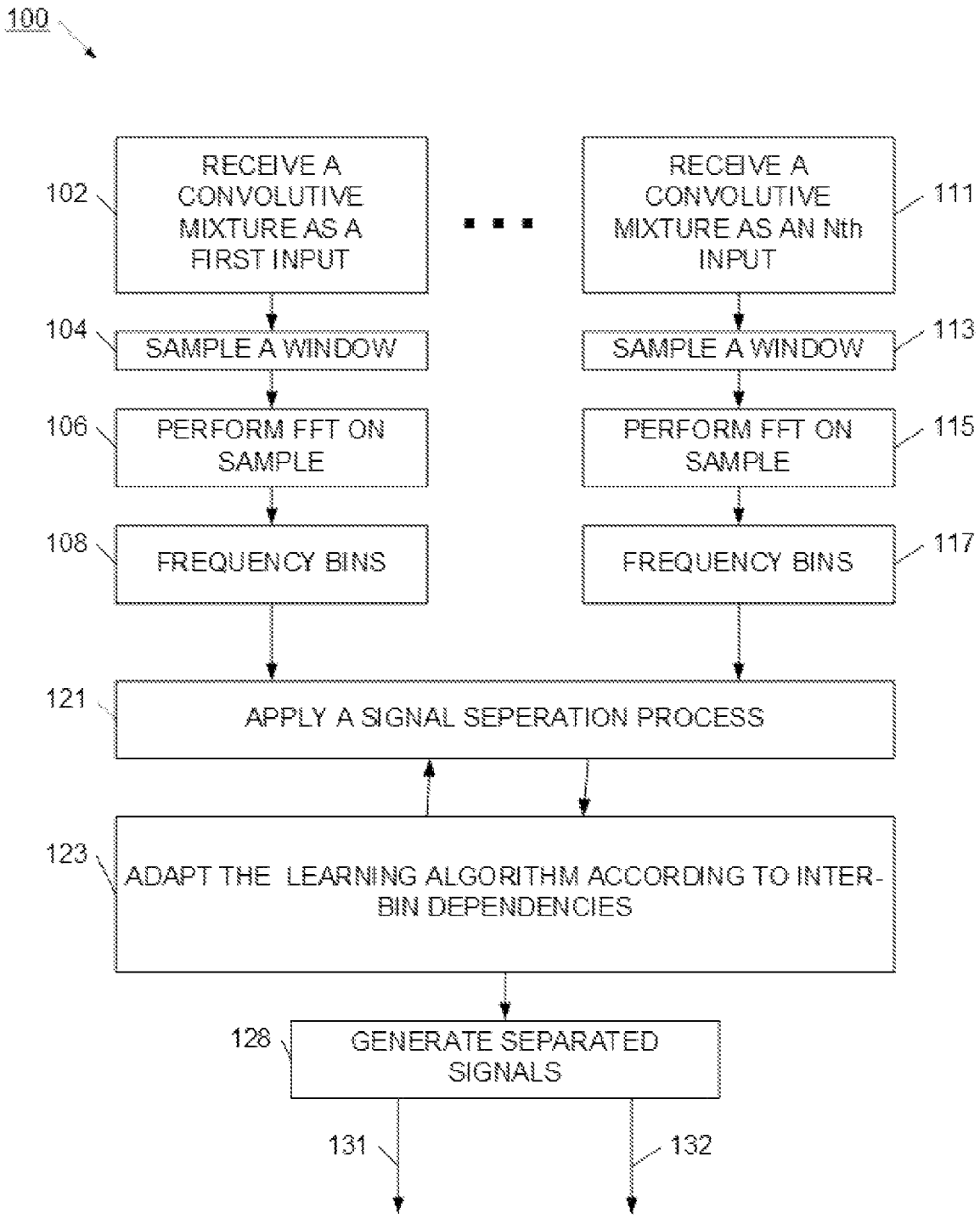
FIG. 3 is a flowchart of an inter-frequency dependent separation process.
Figure 4:
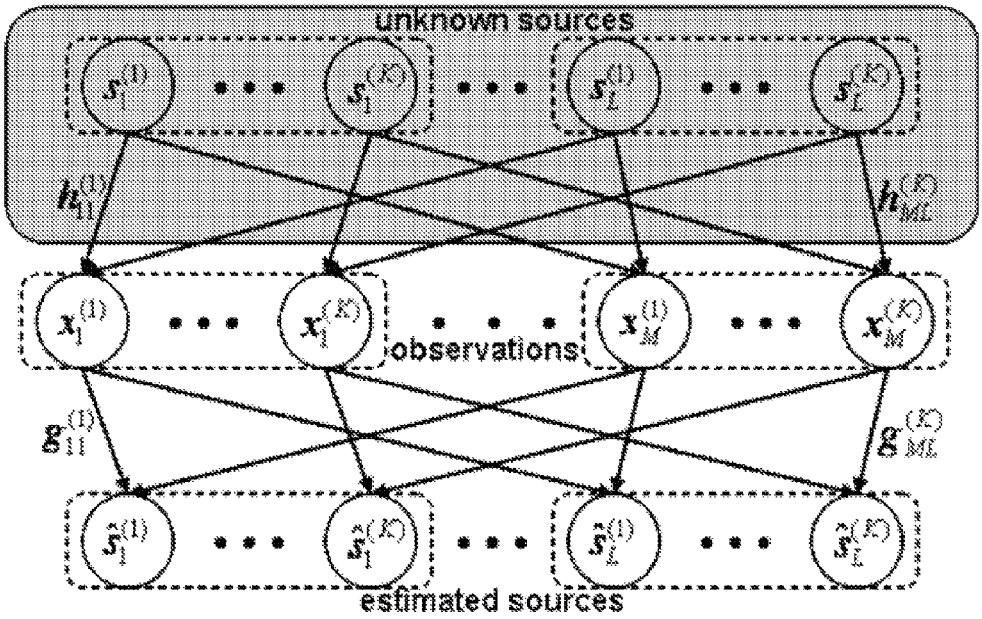
FIG. 4 shows a mixing and separating model for frequency domain BSS according to observed signals.

Referring now to FIG. 3, a process 100 for separating signals is illustrated. Process 100 receives a convoluted mixture as a first input 102 that is used to continually fill a rolling sample window 104. An FFT (fast Fourier Transform) is performed on each sample window as shown in block 106, which operates to fill a set of frequency bins 108. In a similar manner, a convoluted mixture is received at an Nth input as shown in block 111, and a rolling sample window 113 is used to drive a fast Fourier transform process 115 which creates a set of frequency bins 117 for the Nth input. A signal separation process 121 receives the frequency domain bins from all the inputs. The signal separation process 121 has an adaptive learning algorithm which defines an inter-bin frequency dependency. This inter-bin frequency dependency is used to more effectively separate the frequency bins and identify the correct signal source, thereby avoiding the permutation problem. Accordingly, the inter-bin dependency is able to correct bin permutation as shown in block 123. The signal separation process thereby generates separated signals as shown in block 128. The signals 128 are initially frequency domain signals, but may be passed through an inverse fast Fourier transform process to generate time domain separated signals 131 and 132.

Various features and implementations of the frequency dependent signal separation process will be provided in the following sections with reference to FIGS. 4-10. The inter-frequency dependent separation process provides a technique for separating signal sources that have inherent frequency correlations. The technique involves a new algorithm that exploits frequency dependencies of source signals in order to separate them when they are mixed. In frequency domain, this formulation assumes that correlations exist between frequency bins instead of defining independence for each frequency bin which is usually the case in ICA algorithms. In this manner, the new algorithm can substantially avoid the well known frequency permutation problem. The learning algorithm can be derived by log likelihood maximization or mutual information minimization and introduction of a source prior that has frequency dependencies. The signal of interest may be, for example, an acoustic signal, an electrical signal, or other signal that can be obtained through sensors.

Many methods have been created to separate source signals using Blind Source Separation (BSS) or Independent Component Analysis (ICA) techniques. These methods work under the assumption that the source signals of interest are statistically independent. The frequency dependent separation of this application exploits the certain frequency dependencies in source signals that can be captured by a mathematical model. This formulation allows the separation of a wider range of signals in difficult environments. The method includes a generative model for analyzing the data recorded in the environment, a source signal model, and an algorithm for learning the parameters of the unmixing filters. A probabilistic generative model is constructed for the observation and the source signals and derives its learning algorithm via maximum log likelihood or minimum mutual information criterion.

In ICA or BSS there are have been many proposed learning algorithms that yield the separation of signals. Although the exact form of the learning algorithm and therefore the process for learning the separation filters may be different and depending on the proposed learning algorithm, they all can be traced back to have originated from the mutual information criterion. Mutual information measures the difference between the marginal probability densities of the estimated source signals versus the joint probability density of the estimated source signals. There are many ways to approximate probability densities and therefore there are many different algorithms that approximate mutual information. Each of the approximations can lead to a different learning rule. In the techniques described in this application, the ICA or BSS with inter-frequency dependent sources has the same relationship to mutual information and its approximations and therefore there are many learning algorithms that can be derived from the approximations. The main difference to the standard ICA or BSS is that the source probability densities include the inter-frequency dependencies.

In certain implementations, the frequency dependent signal separation process focuses on a multivariate score function, which captures higher-order dependencies in the data. These dependencies are related to an improved model for the source signal prior. While the source priors are defined as independent Laplacian distributions at each frequency bin in most conventional algorithms, the implementations of the present frequency dependent signal separation can utilize higher-order frequency dependencies. In this manner each source prior is defined as a multivariate super-Gaussian distribution, which is an extension of the independent Laplacian distribution. The algorithm itself is able to preserve higher-order dependencies and structures of frequencies. Therefore, the permutation problem is completely avoided, and the separation performances are comparably high even in severe conditions.

BSS is a challenging problem in real world environments where sources are time delayed and convolved. The problem becomes more difficult in very reverberant conditions, with an increasing number of sources, and geometric configurations of the sources such that finding directionality is not sufficient for source separation. The frequency dependent signal separation process uses an algorithm that exploits higher-order frequency dependencies of source signals in order to separate them when they are mixed. In the frequency domain, this formulation assumes that dependencies exist between frequency bins instead of defining independence for each frequency bin. In this manner, the well-known frequency permutation problem is avoided in many situations. To derive the learning algorithm, a cost function is defined, which is an extension of mutual information between multivariate random variables.

By introducing a source prior that models the inherent frequency dependencies, a form of a multivariate score function is obtained. In experiments, simulated data was generated with various environments and various kinds of sources. The performances are evaluated and compared to other well-known algorithms. The results show the present frequency dependent signal separation, when properly implemented, can outperform other conventional techniques in most cases. The algorithm described in this application can also be configured to accurately recover, in a particular example, six sources with six microphones. In this case, an improvement of about 19 dB SIR is obtained. Similar performance is observed in real conference room recordings with three human speakers reading sentences and one loud speaker playing music.

As used throughout, plain lower-case characters are used to denote scalar variables; bold lower-case characters to denote vector variables; and upper-case characters to denote matrix variables. Super-script indicates a frequency bin, and sub-script indicates a source or observation. For example, xi is the ith observation vector that consists of 1:K frequency bins, $[x_i^{(1)}, \ldots, x_i^{(K)}]^T$. x(k) is an observation vector at the kth frequency bin, which consists of 1:M observations at the kth frequency bin, $[x_1^{(k)}, \ldots, x_M^{(k)}]^T$. $H^{(k)} \equiv \{h_{ij}^{(k)}\}$ means that $h_{ij}^{(k)}$ is the ith row, jth column element of the matrix $H^{(k)}$. $x_i^{(k)}[n]$ denotes the nth sample of random variables $x_i^{(k)}$. $x_i^{*(k)}$ denotes the complex conjugate of $x_i^{(k)}$, and $x_i^{\tau}$ denotes the conjugate transpose of $x_i$.

A. Model

The relationship between the sources and observations are defined as follows. Let $x_i(t)$ be the ith observation signal at time t.

$$x_i(t) = \sum_{j=1}^{L} \sum_{\tau=0}^{T-1} h_{ij}(\tau) s_j(t-\tau) \tag{1}$$

where $h_{ij}(t)$ is a time domain transfer function from jth source to ith observation, which has T length in time, $s_j(t)$ is the jth source signal at time t, and L is the number of sources. By executing short time Fourier transform, time domain signal $x_i(t)$ is converted to frequency domain signal $x_i^{(k)}[n]$.

$$x_i^{(k)}[n] = \sum_{t=0}^{K-1} w(t) x_i(nJ+t) e^{-j\omega_k t} \tag{2}$$

where $w_k = 2\pi(k-1)/K$, k=1, 2, . . . , K, J is shift size, and w(t) is a window function.

If the window length, K, is sufficiently longer than the length of the mixing filter $h_{ij}(t)$, the convolution in time domain is approximately converted to multiplication in frequency domain as following.

$$x_i^{(k)}[n] = \sum_{j=1}^{L} h_{ij}^{(k)} s_j^{(k)}[n] \tag{3}$$

If the separating filters exist, that is, the inverses or pseudo-inverses of mixing matrices at each frequency exist (L≤M), then the separated ith source signal is $$\hat{s}_i^{(k)}[n] = \sum_{j=1}^{M} g_{ij}^{(k)} x_j^{(k)}[n] \approx s_i^{(k)}[n] \tag{4}$$

where $g_{ij}^{(k)}$ is the separating filter at kth frequency bin, and M is the number of observed signals.

B. Cost Function

In order to separate multivariate components from multivariate observations, the cost function needs to be defined for multivariate random variables. Here, the Kullback-Leibler divergence is defined between two functions as the measure of independence. One is an exact joint probability density function, $p(\hat{s}_1, \ldots, \hat{s}_L)$ and the other is a nonlinear function which is the product of approximated probability distribution functions of individual source vectors, $\Pi_{i=1}^{L} q(\hat{s}_i)$.

This can be considered an extension of mutual information between multivariate random variables.

$$\begin{aligned} C &= KL\left(p(\hat{s}_1, \ldots, \hat{s}_L) \,\|\, \prod_{i=1}^{L} q(\hat{s}_i)\right) \\ &= \int p(\hat{s}_1, \ldots, \hat{s}_L) \log \frac{p(\hat{s}_1, \ldots, \hat{s}_L)}{\prod_{i=1}^{L} q(\hat{s}_i)} d\hat{s}_1 \ldots d\hat{s}_L \\ &= \int p(x_1, \ldots, x_M) \log p(x_1, \ldots, x_M) dx_1 \ldots dx_M - \\ &\quad \sum_{k=1}^{K} \log|\det G^{(k)}| - \sum_{i=1}^{L} \int p(\hat{s}_i) \log q(\hat{s}_i) d\hat{s}_i \\ &= const. - \sum_{k=1}^{K} \log|\det G^{(k)}| - \sum_{i=1}^{L} E \log q\left(\hat{s}_i^{(1)}, \ldots, \hat{s}_i^{(K)}\right) \end{aligned} \tag{5}$$

$\int p(x_1, \ldots, x_M) \log p(x_1, \ldots, x_L) dx_1 \ldots dx_M$ is the entropy of the observations, which is a constant. Note that the random variables in above equations are multivariate. The interesting parts of this cost function are that each source is multivariate and it would be minimized when the dependency between the source vectors is removed and the dependency between the components of each vector does not need to be removed. Therefore, the cost function preserves the inherent frequency dependency within each source, but it removes dependency between the sources.

C. Learning Algorithm: a Gradient Descent Method

Now that the cost function is defined, derivation of the learning algorithm is more straightforward. Here, a gradient descent method is used to minimize the cost function. By differentiating the cost function C with respect to the coefficients of separating matrices $g_{ij}^{(k)}$, the gradients for the coefficients may be obtained as follows, $$\Delta g_{ij}^{(k)} = -\frac{\partial C}{\partial g_{ij}^{k}} = g_{ij}^{-\dagger(k)} - E\varphi^{(k)}\left(\hat{s}_i^{(1)}, \ldots, \hat{s}_i^{(K)}\right)x_j^{(k)*} \tag{6}$$

where $\left(G^{(k)-1}\right)^{\dagger} \equiv \left\{g_{ij}^{-\dagger(k)}\right\}$.

By multiplying scaling matrices, $(G^{(k)t}G^{(k)}$, to the gradient matrices, $\Delta G^{(k)} \equiv \{g_{ij}^{(k)}\}$, the natural gradient can be obtained, which is known as fast convergence method $$\Delta g_{ij}^{(k)} = \sum_{l=1}^{L}\left(I_{il} - E\varphi^{(k)}\left(\hat{s}_i^{(1)}, \ldots, \hat{s}_i^{(K)}\right)\hat{s}_j^{(k)*}\right)g_{lj}^{(k)} \tag{7}$$

where $I_{i1}$ is 1 only when i=1, otherwise 0, and a multivariate score function is given as $$\varphi^{(k)}\left(\hat{s}_i^{(1)}, \ldots, \hat{s}_i^{(K)}\right) = -\frac{\partial \log q\left(\hat{s}_i^{(1)}, \ldots, \hat{s}_i^{(K)}\right)}{\partial \hat{s}_i^{(k)}} \tag{8}$$

Therefore, the coefficients of separating matrices are updated with the following update rule, $$g_{ij}^{(k)new} = g_{ij}^{(k)old} + \eta\Delta g_{ij}^{(k)} \tag{9}$$

where $\eta$ is learning rate.

D. Scaling Problem and Overlap Add

Although the present algorithm avoids the permutation problem by exploiting the higher-order frequency dependencies, the scaling problem needs to be solved. If the sources are stationary and the variances of the sources are known in all frequency bins, the scaling problem may be solved by adjusting the variances to the known values. However, natural signal sources are dynamic, non-stationary in general, and with unknown variances. Instead of adjusting the source variances, the scaling problem may be solved by adjusting the learned separating filter matrix. One well-known method is obtained by the minimal distortion principle.

Once the learning algorithm is completed, the learned separating filter matrix is an arbitrary scaled version of the exact one, which is given as $$G^{(k)} = D^{(k)}H^{-1(k)} \tag{10}$$

where D(k) is an arbitrary diagonal matrix.

Therefore, by replacing the separating filter matrix as, $$G^{(k)} \leftarrow \mathrm{diag}(G^{-1(k)})G^{(k)} \tag{11}$$

where diag(X) denotes the diagonal matrix of the matrix X, the separating filter matrix can be obtained that has reasonable scales $$G^{(k)} = \mathrm{diag}(H^{(k)})H^{-1(k)} \tag{12}$$

After solving the scaling problem, the finally separated sources are calculated in the frequency domain by Eq. (4). Then, an inverse Fourier transform is performed and overlap added to reconstruct the time domain signal, $$\hat{s}_i(t) = \sum_{n=0}^{N-1}\sum_{k=1}^{K}\hat{s}_i^{(k)}[n]e^{j\omega_k(t-nJ)} \tag{13}$$

where $w_k$, K, and J are the same as those used in Eq. (2). In the case of using a hanning window, the window effect can be avoided by setting shift size, J, to ¼ of the window length, K.

Multivariate Score Function

As shown in the above discussion, a difference between the present algorithm and that of the conventional ICA is a multivariate score function. If a multivariate score function, $\phi^{(k)}(\hat{s}_i^{(1)}, \ldots, \hat{s}_i^{(K)})$ is replaced with a single-variate score function, $\phi(\hat{s}_i^{(K)})$, the algorithm is converted to the same algorithm as the conventional ICA. Therefore, one of the advantages of an implementation of the frequency dependent signal separation is that the score function is a multivariate function.

According to ICA literature, the score function is closely related to the source prior. For example, when the sources are super-Gaussian, Laplacian distribution is widely used. In the present approach, a multivariate score function is also closely related to the source prior, because the cost function in the above discussion includes $q(\hat{s}_i)$, which is an approximated probability distribution function of a source vector, $p(s_i)$. Thus, as shown in Eq. (8), a multivariate score function can be obtained by differentiating log prior with respect to each element of the source vector.

In most BSS approaches, the source prior for super-Gaussian signal is defined by Laplacian distribution. So supposing that the source prior of vector is independent Laplacian distribution in each frequency bin, this can be written as $$p(s_i) = \sum_{k=1}^{K}p\left(s_i^{(k)}\right) = \alpha\prod_{k=1}^{K}\exp\left(-\frac{1}{\sigma_i^{(k)}}|s_i^{(k)} - \mu_i^{(k)}|\right) \tag{14}$$

where $\sigma$ is a normalization term, and $u_i^{(k)}$ and $\sigma_i^{(k)}$ are mean and variance of ith source signal at the kth frequency bin, respectively.

Assuming zero mean and unit variance, the score function is given as $$\varphi^{(k)}\left(\hat{s}_i^{(1)}, \ldots, \hat{s}_i^{(K)}\right) = \frac{\partial\sum_{k=1}^{K}|\hat{s}_i^{(k)}|}{\partial\hat{s}_i^{(k)}} = \frac{\hat{s}_i^{(k)}}{|\hat{s}_i^{(k)}|} = \exp\left(j\cdot\arg(\hat{s}_i^{(k)})\right) \tag{15}$$

Indeed, Eq. (15) is not a multivariate function, because the function depends on only a single variable, $\hat{s}_i^{(k)}$. Therefore, instead of using an independent prior, a new prior is defined, which is highly dependent on the other elements of a source vector.

In this approach, the source prior is defined as a higher-orderly dependent distribution, which can be generally written as $$p(s_i) = \alpha\cdot\psi(\delta_\lambda(s_i)) \tag{16}$$

$$\delta_\lambda(s_i) = \left(\sum_k\left(|s_i^{(k)} - \mu_i^{(k)}|/\sigma_i^{(k)}\right)^\lambda\right)^{1/\lambda} \tag{17}$$

where $\alpha$ is a normalization term, $\psi(\bullet)$ is an arbitrary function, and $\mu_i^{(k)}$ and $\sigma_i^{(k)}$ are mean and variance of kth frequency component of ith source signal, respectively.

Figure 5A:
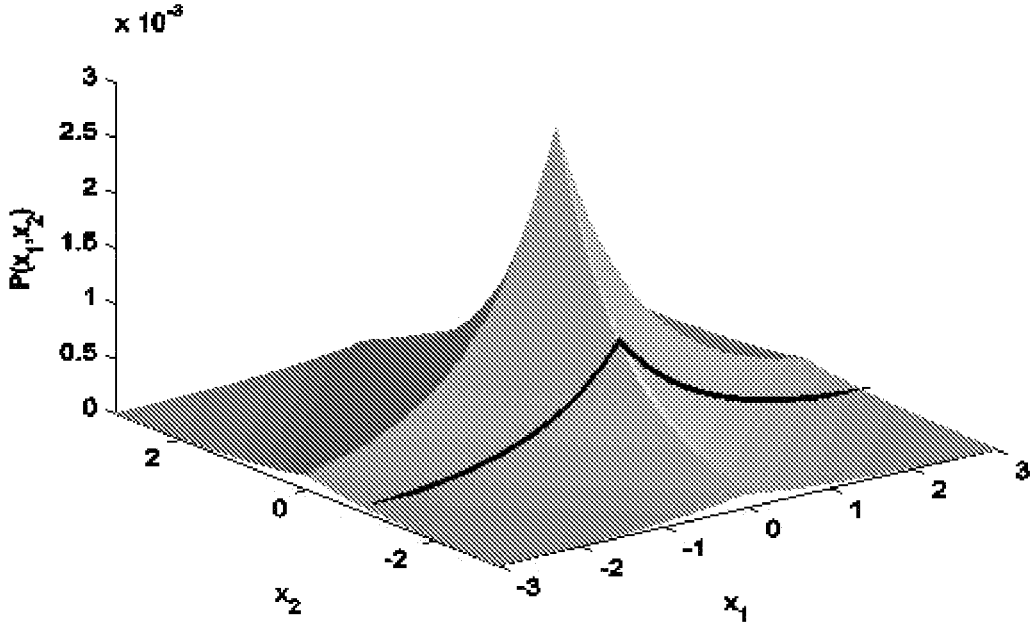
FIG. 5 shows a comparison between independent Laplacian distribution and dependent multivariate super-Gaussian distribution.
Figure 5B:
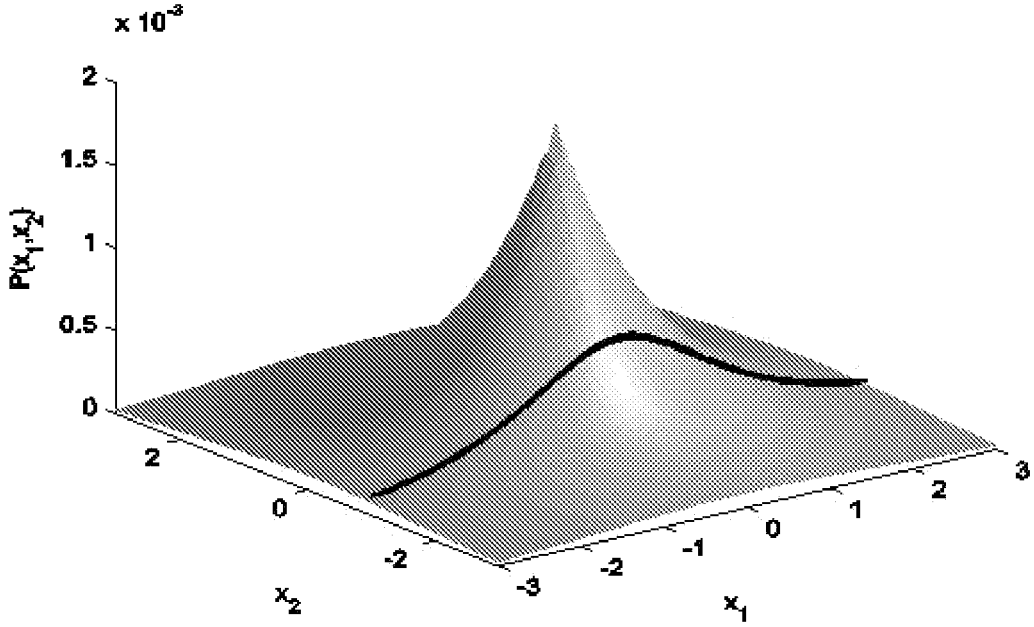

For example, to obtain a dependent multivariate super-Gaussian distribution, we may choose $\lambda=2$ and $\psi(\bullet)=\exp(\bullet)$. FIG. 5 shows the difference between the assumption of independent Laplacian distribution and dependent multivariate super-Gaussian distribution. In FIG. 5(B), the joint distribution of $x_1$ and $x_2$ does not display any directionality which means $x_1$ and $x_2$ are uncorrelated. However, the marginal distribution of $x_1$ is different from the joint distribution of $x_1$ given $x_2$, that is, $x_1$ and $x_2$ are highly dependent. It should be noted that natural signal sources in the frequency domain have inherent dependencies and it can be observed that dependencies exist among frequency bins. This allows the source prior to use and exploit higher-order dependencies between frequency bins.

Since Fourier outputs have zero means, the scale is adjusted after learning, $\mu_i^{(k)}$ and $\sigma_i^{(k)}$ may be set to be 0 and 1, respectively.

Consequently, the multivariate score function is given as $$\varphi^{(k)}(\hat{s}_i^{(1)}, \ldots, \hat{s}_i^{(K)}) = -\frac{\psi'(\delta_\lambda(s_i))}{\psi(\delta_\lambda(s_i))} \cdot q'_\lambda(s_i) = \xi(\delta_\lambda(s_i)) \cdot \frac{s_i^{(k)}}{s_\lambda(s_i)} \tag{18}$$

For example, when $\lambda=2$ and $\psi(\bullet)=\exp(\bullet)$, the multivariate score function is given as $$\varphi^{(k)}(\hat{s}_i^{(1)}, \ldots, \hat{s}_i^{(K)}) = \frac{s_i^{(k)}}{\sqrt{\sum_k |s_i^{(k)}|^2}} \tag{19}$$

Since the form of a multivariate score function is related to dependency of sources, the proper form of a multivariate score function might vary with different types of dependency, as apparent to one having ordinary skill in the art.

EXAMPLES AND RESULTS

The performance of the present algorithm was evaluated using both simulated and real data. Simulated data were obtained by simulating impulse responses of a rectangular room based on the image model technique. The image model technique is a well know testing and simulation process discussed, for example, in R. B. Stephens and A. E. Bate, *Acoustics and Vibrational Physics*. Edward Arnold Publishers, 1966. To generate the microphone signals, real sound signals sampled at 8 kHz were convolved with corresponding room impulse responses. The present algorithm was compared with two well-known frequency domain BSS algorithms, Parra and Spence, and Murata et. al.

Parra and Spence's algorithm avoids the permutation problem by limiting the length of the filter in the time domain to smoothen the shape of the filter in the frequency domain, while learning the separating filters. Murata et al.'s algorithm corrects the permutation problem by considering the correlations of frequency bins, after separating the sources in each frequency bin. The performances were measured by signal to interference ratio (SIR) in dB defined as $$SIR_{in} = 10\log\frac{\sum_{n,k}\left|\sum_i h_{iq(i)}^{(k)}\hat{s}_{q(i)}^{(k)}[n]\right|^2}{\sum_{n,k}\left|\sum_{i\neq j} h_{iq(i)}^{(k)}\hat{s}_{q(i)}^{(k)}[n]\right|^2} \tag{20}$$

$$SIR_{out} = 10\log\frac{\sum_{n,k}\left|\sum_i r_{iq(i)}^{(k)}\hat{s}_{q(i)}^{(k)}[n]\right|^2}{\sum_{n,k}\left|\sum_{i\neq j} r_{iq(i)}^{(k)}\hat{s}_{q(i)}^{(k)}[n]\right|^2} \tag{21}$$

where q(i) indicates separated source index that ith source appears, and $r_{iq}^{(k)}(j)$ is an overall impulse response, which is defined by $\Sigma_m g_{im}^{(k)} h_{mq}^{(k)}(j)$.

Real data were obtained in an ordinary conference room, where human speakers read several sentences and loud speakers played music. In all experiments, a 2048 point FFT and Hanning window were used to convert time domain signals to frequency domain. The length of window was 2048 samples and shift size was 512 samples. Initial values for the present and Murata et. al.'s algorithm was chosen as whitening matrix in each frequency bin. The algorithm ran until the decrement of the cost function was less than $10^{-3}$.

To execute Parra and Spence's algorithm, the code may be downloaded from http://ida.rst.gmd.de/~harmeli/download/downloadconvbss.html, or may be found in the known literature. The same number of FFT points was used and the length of time domain filter was limited to 512, which provided best performances.

First, the present algorithm was applied to the problem with two microphones and two sources in simulated room environments. The room size was assumed to be 7 m×5 m×2.75 m. For an intensive analysis, the performances were evaluated with a number of source locations and reverberation times varying from 50 ms to 300 ms, for which the corresponding reflection coefficients were from 0.32 to 0.83 for all walls, floor, and ceiling. All the heights of sources and microphones were 1.5 m.

Figure 6A:
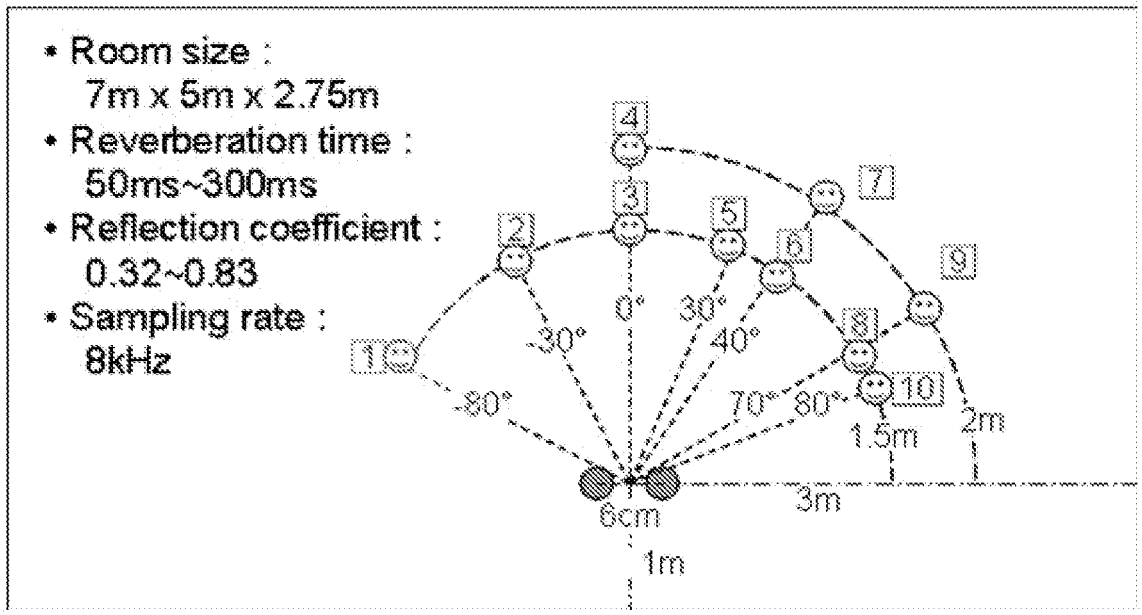
FIG. 6 shows simulated room environments.

The environments are shown in FIG. 6(A), in which seven pairs of source locations were chosen. Although two cases of locations, such as 1 and 8, and 2 and 6 are comparably easier cases, 5 and 6, and 8 and 10 are more difficult cases because the sources are located on the same side and have similar DOAs. The other 3 cases, such as 3 and 4, 6 and 7, and 8 and 9 are ill-posed problems, that is, the most difficult cases, because the sources are located closely as well as having the same DOAs.

FIG. 7 shows the results of all cases with varying reverberation time, when one source was a male speech, and the other was a female speech. In all cases, SIRin was approximately 0 dB. As shown in FIG. 7, the present algorithm outperforms the others in most cases. At worst, the others algorithms do not exceed the described implementation of the present frequency dependent signal separation by more than 2 dB in certain cases. One disadvantage of Parra and Spence's algorithm is that it cannot use the full length of the filter, because it limits the filter length to avoid permutation. Thus, the actual filter length was 512, even though a 2048 point FFT filter was used here. The performances of their algorithm degraded more than that of the implementation of the present frequency dependent signal separation, when the reverberation time was long and the source locations were difficult.

Murata et. al.'s algorithm is not robust, because a misalignment of permutation at a frequency bin may cause consecutive misalignments of neighbor frequency bins. So, their algorithm performs poorly in some cases although it performs better in a certain case. However, the present algorithm overcomes these disadvantages. For example, it does not limit the filter length. It is also very robust.

In addition to the experiment described above, another experiment was conducted to show how the performances are affected by the kind of sources. Instead of using only speech signals, other sounds were also used, including babble noise sound, rock music, and classic music as source signals. Four different pairs of sources were selected: male speech and female speech, male speech and rock music, female speech and babble noise, and rock music and classic music.

Figure 8A:
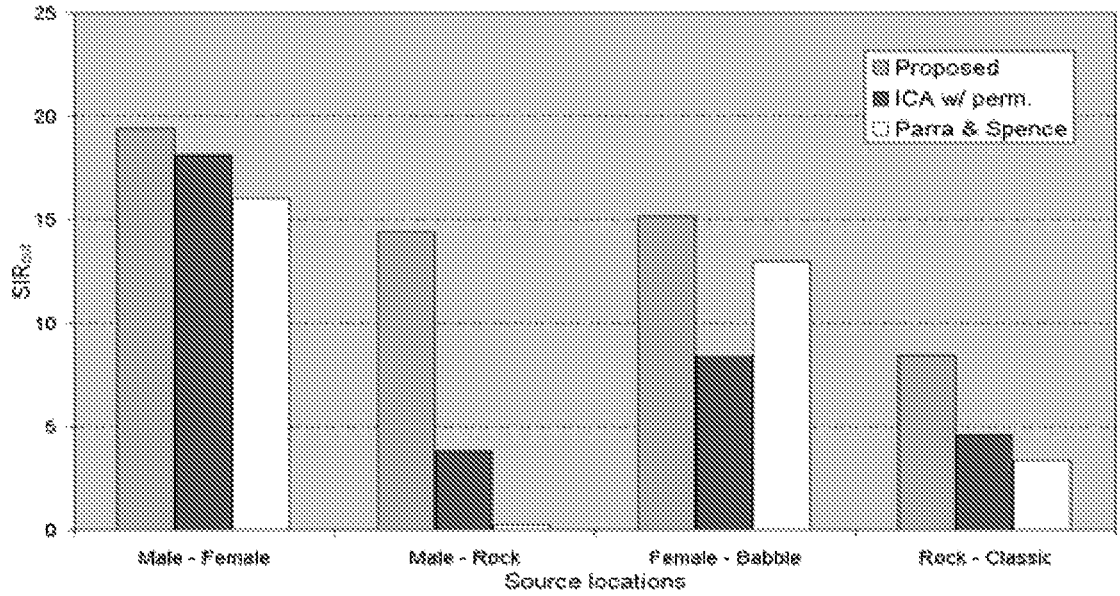
FIG. 8 shows graphs of results comparing known signal separation processes to an inter-frequency dependent separation system.
Figure 8B:
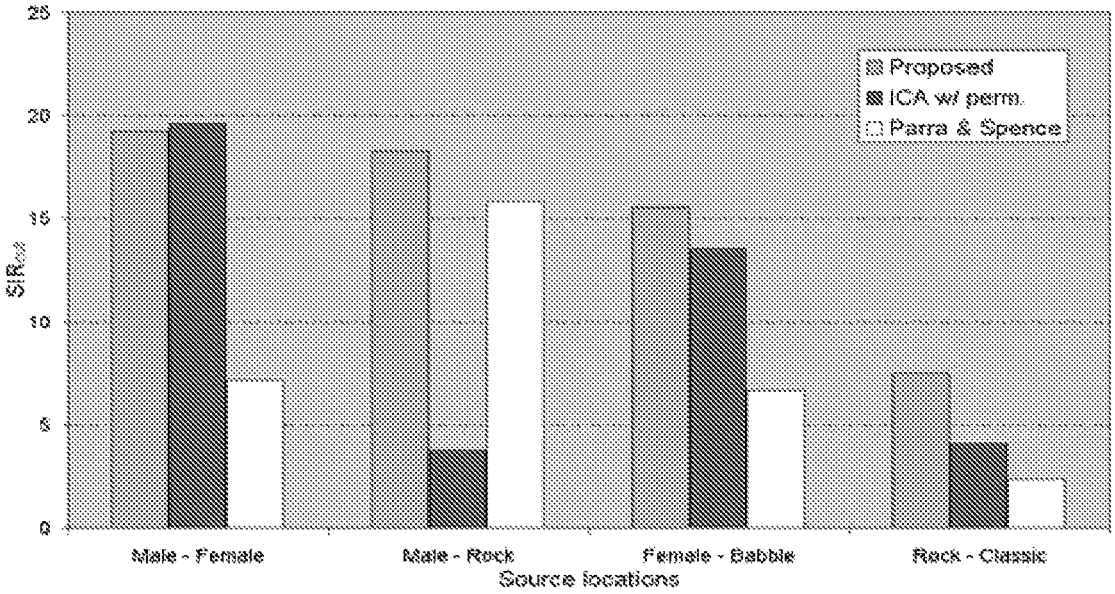

As shown in FIG. 8, the present algorithm outperformed others. Therefore, the source model discussed above is appropriate not only to separate speeches but also to other signals that have frequency dependencies.

Figure 6B:
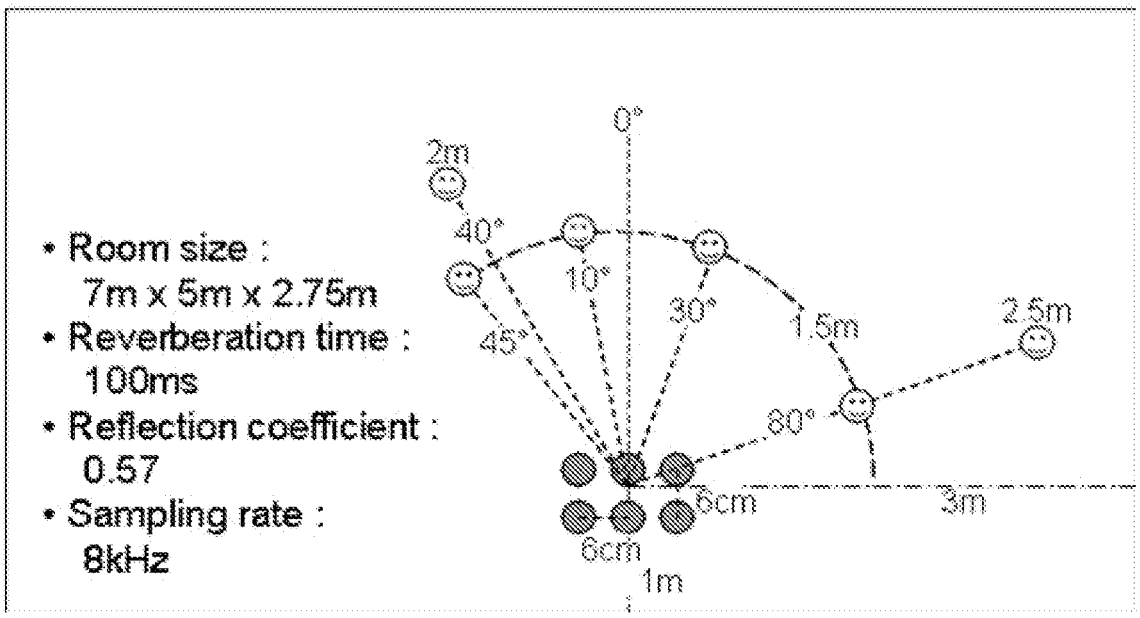
Figure 7A:
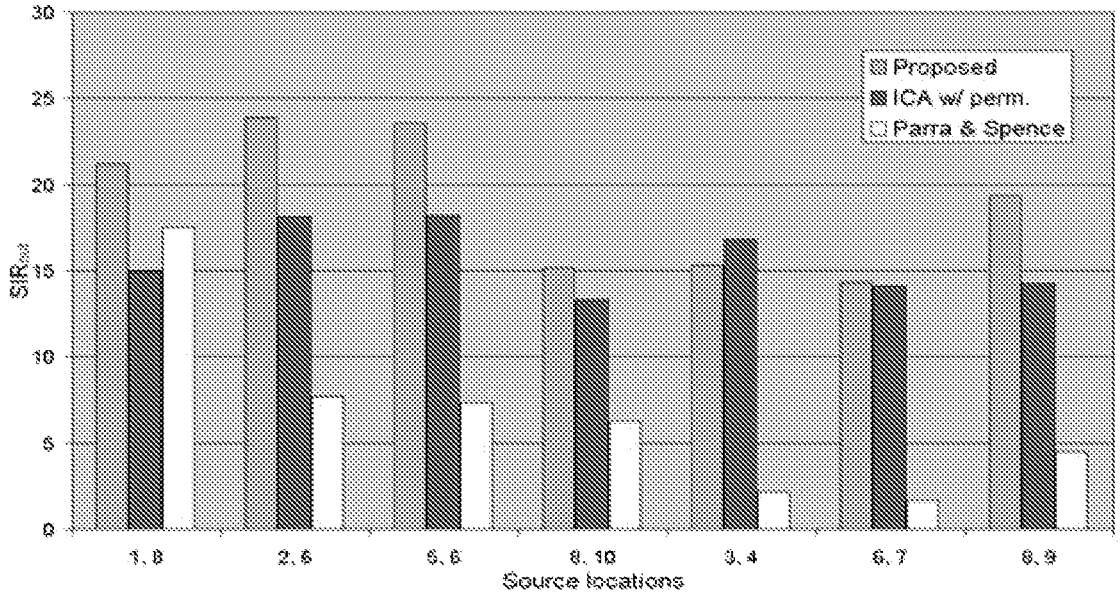
FIG. 7 shows graphs of results comparing known signal separation processes to an inter-frequency dependent separation system.
Figure 7B:
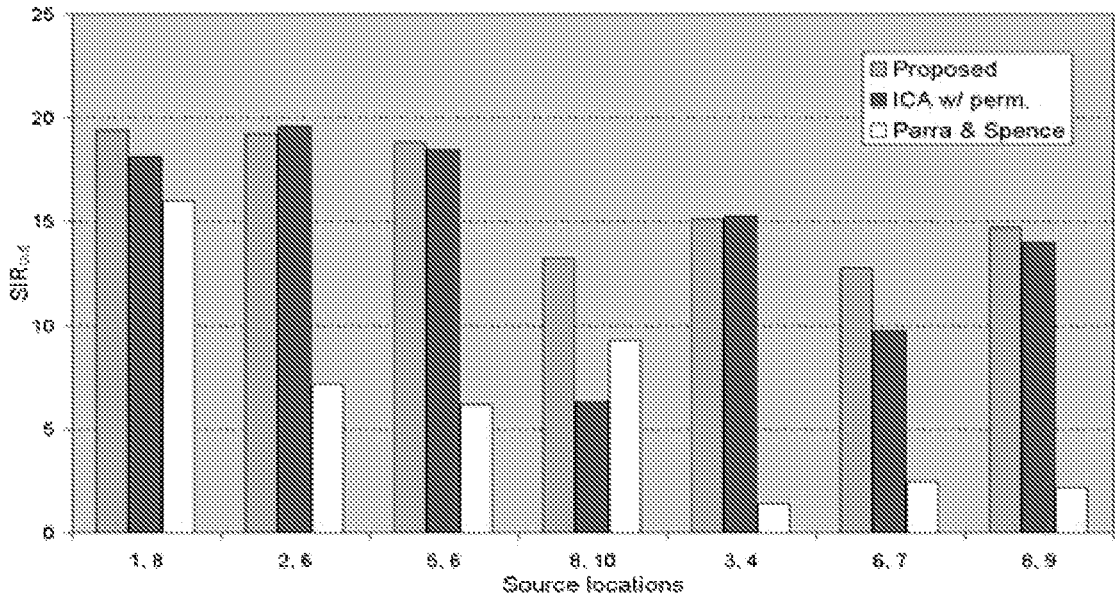
Figure 7C:
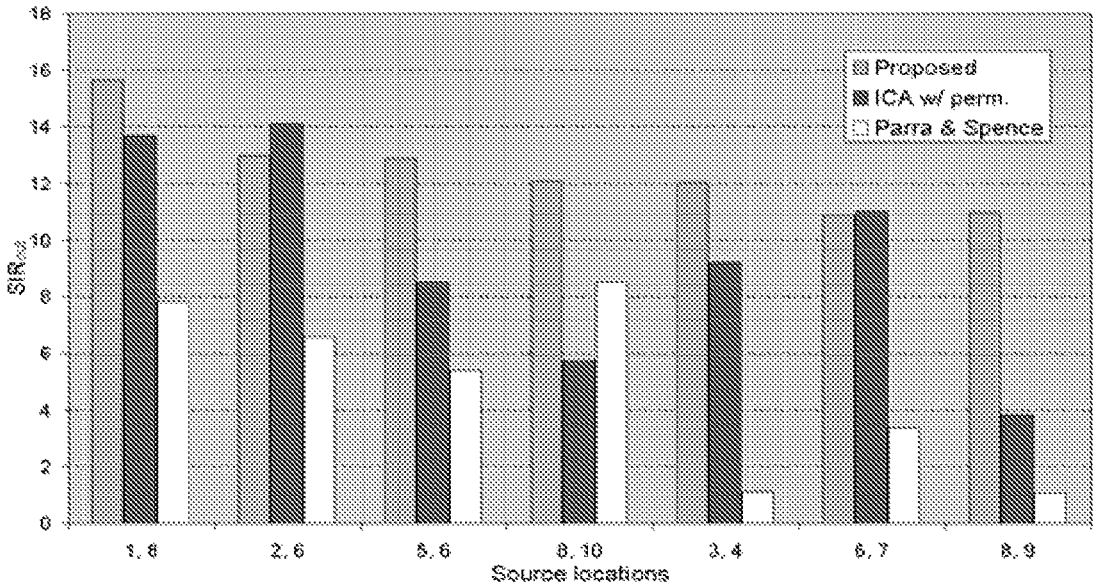
Figure 7D:
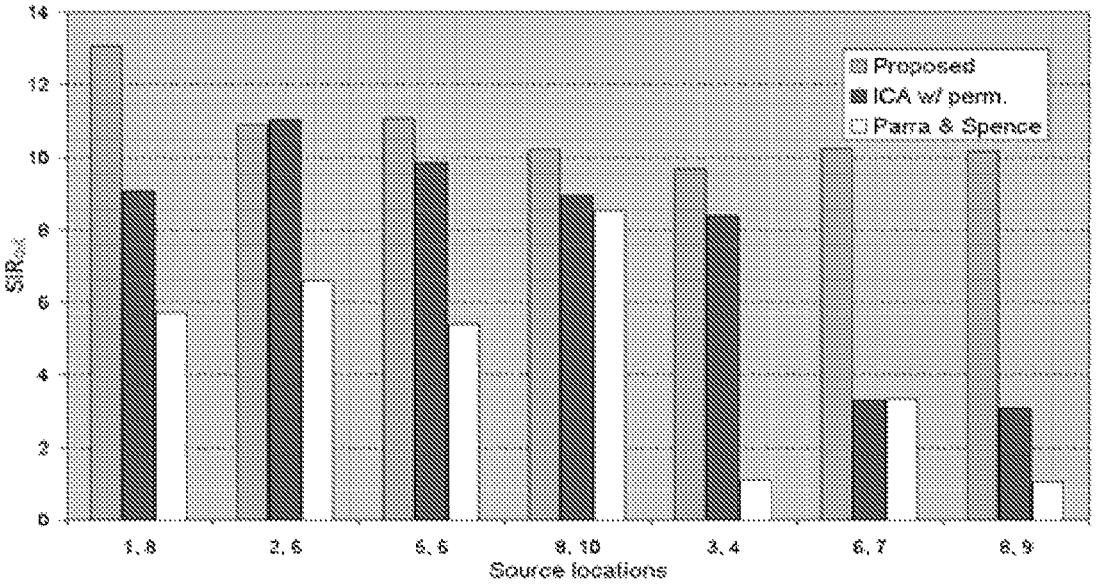
Figure 9:
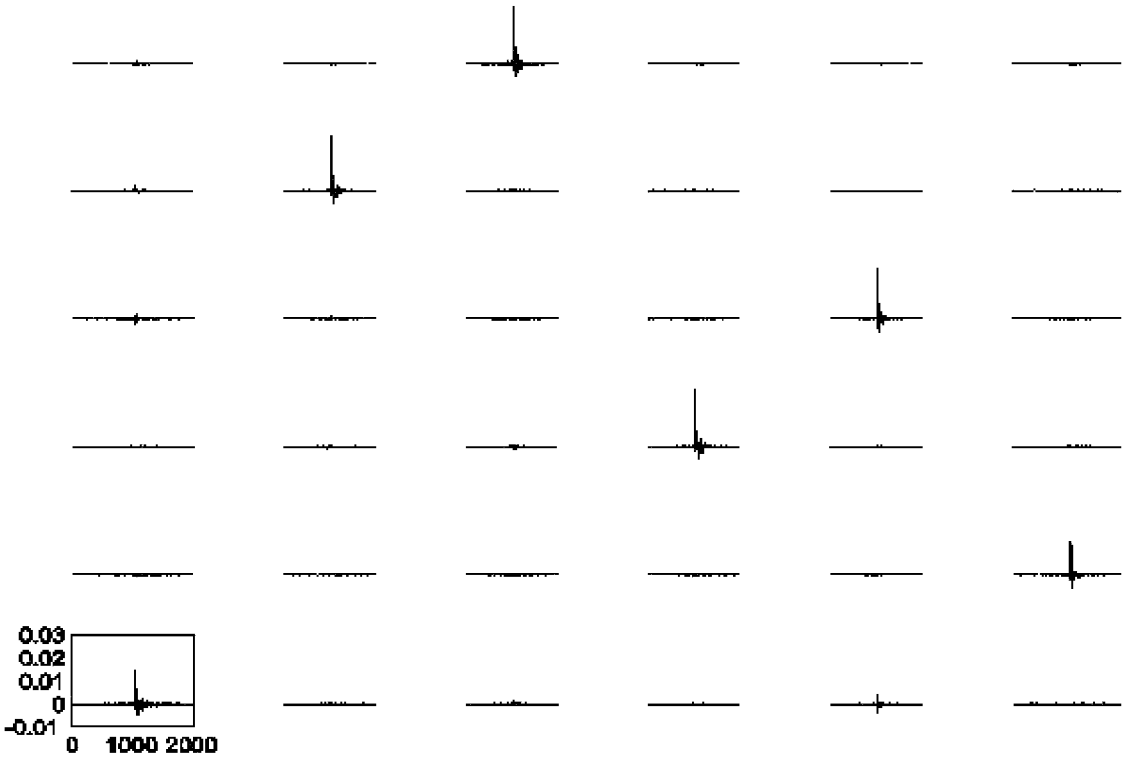
FIG. 9 shows overall impulse responses for the higher-order dependency signal separation process.
Figure 10:
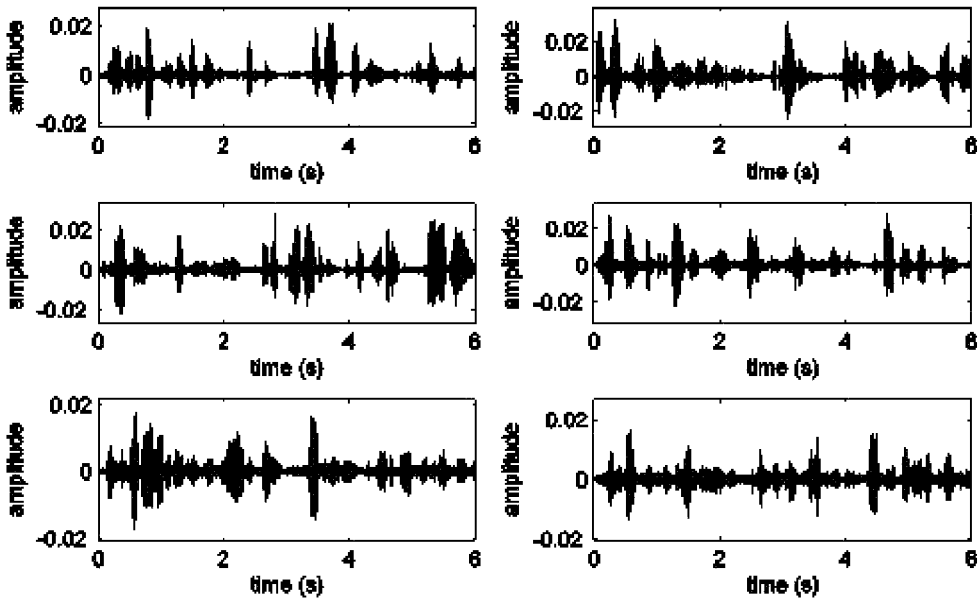
FIG. 10 shows separated output signals from six input signals using an inter-frequency dependent separation process.

Yet another more challenging experiment was performed, which included more than two sources and microphones. The simulated room condition was the same as the previous experiment with two sources and two microphones. FIG. 6(B) shows the room condition and the locations of the sources and microphones, in which some sources were located very closely, and other sources had the same DOAs. In this experiment, SIRin was −7 dB, and SIRout of the present algorithm was 12 dB. However, SIRout of the other algorithms did not exceed 0 dB. That is, conventional algorithms could not separate the sources. FIG. 9 shows overall impulse responses and FIG. 10 shows separated source signals in time domain.

In another experiment, real data was recorded in an ordinary conference room that had long reverberation time. Four microphones were located in a line. The sources consisted of three human speakers reading sentences, and a hip-hop music from a loud speaker, which was located approximately 1 m-2 m from the microphones. Three human speakers were located approximately 1 m-2 m from the microphones, and read several sentences. The approximate SIR improvement was about 14 dB. Audio files and detailed information are available on http://inc2.ucsd.edu/taesu/source_separation.html.

So far, what is needed to derive the algorithm is a new prior. Using the present algorithm, many new derivations may be made. There are several interesting observations in this approach. On one hand, a more precise source prior is helpful in finding a solution. The defined source prior model though is still rough and assumes only a simple dependency among all frequencies. This prior model is therefore applicable to many natural signals since they all display certain dependencies and are not random. On the other hand, it can be shown that this approach tries to capture higher-order dependencies in the data.

Capturing those signal dependencies has shown its significance in applications where the independence assumption of sources is too strong and maybe not realistic. Several approaches have been proposed that perform a variation of the ICA by defining dependencies of the components. Most of these approaches are to extract interesting features from data (unsupervised learning). None of those approaches considered the modeling of dependencies of sources in a convolved scenario. Interestingly, Hyvärinen and Hoyer's work is somewhat related to our source definition model (see, A. Hyvärinen and P. O. Hoyer, *Emergence of phase and shift invariant features by decomposition of natural images into independent feature subspaces, Neural Computation*, vol. 12, no. 7, pp. 1705-1720, 2000). They defined the norm of each subspace output as a super-Gaussian distribution. In their approach, they were interested in modeling dependencies in image subspaces. Their results provide grouping of subspaces or features (topographic ICA or independent subspace analysis). A common feature of the dependency models is that they measure the variance of the source signal to approximate the higher-order dependencies in the data.

Although it appears that two viewpoints are used in explaining the present approach, namely the source prior and the dependency model, it is important to note that this model cannot be simply reduced to a use of a different source prior. The present approach is better understood by capturing nonlinear dependencies in the data. For a given source estimate, the score function in the learning rule does not only depend on one frequency but it includes all frequencies in a nonlinear way. This is somewhat similar to the subspace or topographic ICA and other nonlinear dependency models where the nonlinear dependencies are considered more precisely (see, for example, Y Karklin and M. S. Lewicki, *Learning higher-order structures in natural images, Network: Computation in Neural Systems*, vol. 14, no. 3, pp. 483-499, 2003; and H.-J. Park and T.-W. Lee, *Unsupervised learning of nonlinear dependencies in natural images, in Adv. Neural Information Processing Systems*).

This approach may also be viewed as a form of the ICA for multidimensional components. Several observations have been made which are mixed with independent sources, and each observation is a vector such as the output of the Fourier transform. Each source is also a vector which has same dimension as each observation. In this sense, the present frequency dependent signal separation exploits dependencies of the frequencies inherent in the source signal. In terms of the subspace interpretation, each source vector can be considered as independent of the others, but the vector components of each source are highly dependent on each other. Therefore, the present algorithm may be considered as a generalization of the ICA algorithm to vectorized form of the observations and sources. It may also be termed independent vector analysis.

In a vector domain, especially a Fourier domain, the blind source separation of convolutive mixture in time domain equals now the blind source separation of instantaneous mixture. An advantageous consequence of the present approach in the frequency domain for blind source separation is that the use of dependent prior information avoids the permutation problem.

A new algorithm is proposed for BSS that exploits higher-order frequency dependencies, leading to a generalization of the ICA algorithm to a vectorized form of observations and sources. Instead of defining independence for each frequency bin, it is assumed that frequencies have higher-order dependencies, which caused a multivariate score function. Simply stated, a major difference between the present algorithm from that of conventional ICA is the fact that the score function is a multivariate function. But, it does not need to correct a permutation problem. Thus, the complexity of the algorithm is very low. The experimental results showed that the present algorithm is very robust and precise in most cases. Additionally, using the present algorithm, it was possible to separate six speakers reliably and similar performance was observed in real world recordings of four sources mixed in a conference room environment. The results suggest that exploiting higher-order source dependencies is a key in separating sources in challenging environments and under ill-posed conditions.

The proposed algorithm is a general method that includes a learning or adaptation rule which can be derived from the mutual information or maximum likelihood cost function and it is not dependent on a certain type of signal or data. The algorithm is applicable to many data types and signal sources. In one example of using the new algorithm, the algorithms may operate on acoustic signals generated by transducers. However, a similar algorithm and methodology may be advantageously applied to other fields of use and types of data, such as biomedical data, spectral data and data used in telecommunication systems.

In just one example in a biomedical application, the algorithm may be used to separate cardiac signals that have dependencies over time. The algorithm can therefore capture and separate cardiac rhythms that may not be independent. It will be understood that other types of biomedical data may be used.

In a spectral application the algorithm may be used to separate spectrally independent as well as dependent source signals. In particular applications such as magnetic resonance imaging the neighboring frequency spectra may be dependent whereas far away spectra may be independent and the algorithm would help in elucidating the relationship between the spectral components.

In communications applications, the algorithm can be used to separate mixed communication source signals that are measured with multiple antennas. In applications of MIMO (Multiple Input and Multiple Output) systems such as OFDM (Orthogonal Frequency Division Multiplexing), the algorithm can be used to separate communication signals and to enhance signal to noise ratio after channel equalization. This may lead to improved BER (Bit Error Rate) or improved convergence speed or improved training schedules.

There acoustic applications, the algorithm can be used to separate acoustic echoes that are caused by a far end signal through a loud speaker. This process leads to echo cancellation. In one embodiment the algorithm can be used without any modification and with multiple microphones to suppress the echo. In another embodiment the algorithm can be modified to use the far end signal to suppress the echo similar to known echo suppression methods for single or multiple microphone usage scenarios.

Embodiments of the invention and all of the functional operations described in this specification can be implemented in digital electronic circuitry, or in computer software, firmware, or hardware, including the structures disclosed in this specification and their structural equivalents, or in combinations of one or more of them. Embodiments of the invention can be implemented as one or more computer program products, i.e., one or more modules of computer program instructions encoded on a computer readable medium for execution by, or to control the operation of, data processing apparatus. The computer readable medium can be a machine-readable storage device, a machine-readable storage substrate, a memory device, a composition of matter effecting a machine-readable propagated signal, or a combination of one or more them. The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them. A propagated signal is an artificially generated signal, e.g., a machine-generated electrical, optical, or electromagnetic signal, that is generated to encode information for transmission to suitable receiver apparatus.

A computer program (also known as a program, software, software application, script, or code) can be written in any form of programming language, including compiled or interpreted languages, and it can be deployed in any form, including as a stand alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understand as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

The foregoing disclosure of various implementation and embodiments of the present frequency dependent signal separation has been presented for purposes of illustration and description. It is not intended to be exhaustive or to limit the invention to the precise forms disclosed. Many variations and modifications of the embodiments described herein will be apparent to one of ordinary skill in the art in light of the above disclosure.

Further, in describing representative implementations and embodiments of the present invention, the specification may have presented the method or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method or process of the present invention should not be limited to the performance of their steps in the order written, and one skilled in the art can readily appreciate that the sequences may be varied and still remain within the spirit and scope of the present invention.

What is claimed is:

1. A signal separation process, comprising:

receiving a plurality of mixed input signals at a data processing apparatus, each mixed signal being a mixture of a plurality of signal sources;

using the data processing apparatus, sampling each mixed input signal using a respective rolling sampling window;

using the data processing apparatus, transforming signal data in each current sampling window to frequency domain data sets;

receiving the frequency domain data sets as inputs to an inter-frequency dependent separation process at the data processing apparatus;

operating the inter-frequency dependent separation process at the data processing apparatus, the inter-frequency dependent separation process comprising adapting a learning algorithm using an inter-frequency dependency;

identifying, by the data processing apparatus, each component of the frequency domain data according to its correct signal source; and generating, by the data processing apparatus, a separated signal for at least one of the signal sources, wherein the inter-frequency dependent separation process uses a multivariate score function defined by the equation:

$$\varphi^{(k)}\left(\hat{s}_i^{(1)}, \ldots, \hat{s}_i^{(K)}\right) = -\frac{\psi'(\delta_\lambda(s_i))}{\psi(\delta_\lambda(s_i))} \cdot q'_\lambda(s_i) = \xi(\delta_\lambda(s_i)) \cdot \frac{s_i^{(k)}}{\delta_\lambda(s_i)}$$

$$\delta_\lambda(s_i) = \left(\sum_k \left(|s_i^{(k)} - \mu_i^{(k)}| / \sigma_i^{(k)}\right)^\lambda\right)^{1/\lambda}$$

wherein k represents a frequency bin within range 1 to K, $\phi(\bullet)$ is the score function, $s_i^k$ is the $i^{th}$ source signal for frequency bin k, $\hat{s}_i^k$ is the separated $i^{th}$ source signal for frequency k, $\psi(\bullet)$ is an arbitrary function, $\mu_i^k$ and $\sigma_i^k$ are mean and variance, respectively, of the $k^{th}$ frequency bin within $i^{th}$ signal, q' is first derivative of approximated probability density function q(s), $\delta_\lambda(s)$ is the $\lambda^{th}$ norm of vector s, and $\xi(x)$ is an arbitrary non-linear function of x.

2. The signal separation process according to claim 1, wherein the learning algorithm is derived from a cost function that uses a multi-variate super-Gaussian distribution.

3. The signal separation process according to claim 1, wherein the learning algorithm is derived from a cost function that is selected to preserve frequency dependencies within each signal source, but remove dependencies between signal sources.

4. The signal separation process according to claim 1, wherein the learning algorithm is derived from a cost function:

$$C = const. - \sum_{k=1}^{K} \log|\det G^{(k)}| - \sum_{i=1}^{L} E\log q\left(\hat{s}_i^{(1)}, \ldots, \hat{s}_i^{(K)}\right)$$

wherein k represents a frequency bin within range 1 to K, $\hat{s}_i^k$ is the separated $i^{th}$ source signal for frequency bin k, E denotes expectation or mean, q(s) is approximated probability density function of s, $G^k$ is a separator matrix for frequency bin k, and const. represents a constant value.

5. The signal separation process according to claim 1, wherein the signal sources are acoustic signal sources.

6. The signal separation process according to claim 1, wherein the signal sources are acoustic signal sources and at least one of the signal sources is a speech signal source.

7. The signal separation process according to claim 1, wherein the signal sources are medical signal sources, physiological signal sources, image signal sources, data signal sources, or spectral signal sources.

8. The signal separation process according to claim 1, wherein the plurality of mixed input signals are acoustics signals, biomedical signals, spectral signals, or communication signals.

9. The signal separation process according to claim 1, wherein the separated signal is a separated acoustic speech signal, a separated cardiac signal, a separated MRI signal, or a separated digital communication signal.

10. A signal separation process, comprising:

receiving a plurality of mixed input signals at a data processing apparatus, each mixed signal being a mixture of a plurality of signal sources;

using the data processing apparatus, sampling each mixed input signal using a respective rolling sampling window;

using the data processing apparatus, transforming signal data in each current sampling window to frequency domain data sets;

receiving the frequency domain data sets as inputs to an inter-frequency dependent separation process at the data processing apparatus;

operating the inter-frequency dependent separation process at the data processing apparatus, the inter-frequency dependent separation process comprising adapting a learning algorithm using an inter-frequency dependency;

identifying, by the data processing apparatus, each component of the frequency domain data according to its correct signal source; and generating, by the data processing apparatus, a separated signal for at least one of the signal sources, wherein the inter-frequency dependent separation process uses a probability density function that defines signal source frequency dependency as defined by the equation:

$$p(s_i) = \alpha \cdot \psi(\delta_\lambda(s_i))$$

$$\delta_\lambda(s_i) = \left(\sum_k \left(|s_i^{(k)} - \mu_i^{(k)}| / \sigma_i^{(k)}\right)^\lambda\right)^{1/\lambda}$$

Wherein, p(•) is probability distribution function, $\alpha$ is a normalization term, k represents a frequency bin within range 1 to K, $s_i^k$ is the $i^{th}$ source signal for frequency bin k, $\psi(\bullet)$ is an arbitrary function, $\mu_i^k$ and $\sigma_i^k$ are mean and variance, respectively, of the $k^{th}$ frequency bin within $i^{th}$ signal, and $\delta_\lambda(s)$ is the $\lambda^{th}$ norm of vector s.

11. A communication system, comprising a communication device which comprises:

at least two microphones connected to respective analog to digital converters, each converter configured to generate respective digitized mixed signal data comprising a plurality of signal sources; and a processor operable to transform the digitized signal data to frequency domain data sets;

receive the frequency domain data sets as inputs to an inter-frequency dependent separation process;

adapt the inter-frequency dependent separation process using a higher order frequency dependency, the higher order frequency dependency being used as part of the separation process that produces separate frequency domain data from the input frequency domain data sets; and generate a separated signal representing at least one of the signal sources using a multivariate score function defined by the equation:

$$\varphi^{(k)}\left(\hat{s}_i^{(1)}, \ldots, \hat{s}_i^{(K)}\right) = -\frac{\psi'(\delta_\lambda(s_i))}{\psi(\delta_\lambda(s_i))} \cdot q'_\lambda(s_i) = \xi(\delta_\lambda(s_i)) \cdot \frac{s_i^{(k)}}{\delta_\lambda(s_i)}$$

$$\delta_\lambda(s_i) = \left(\sum_k \left(|s_i^{(k)} - \mu_i^{(k)}| / \sigma_i^{(k)}\right)^\lambda\right)^{1/\lambda}$$

wherein k represents a frequency bin within range 1 to K, $\phi(\bullet)$ is the score function, $s_i^k$ is the $i^{th}$ source signal for frequency bin k, $\hat{s}_i^k$ is the separated $i^{th}$ source signal for frequency k, $\psi(\bullet)$ is an arbitrary function, $\mu_i^k$ and $\sigma_i^k$ are mean and variance, respectively, of the $k^{th}$ frequency bin within $i^{th}$ signal, q' is first derivative of approximated probability density function q(s), $\delta_\lambda(s)$ is the $\lambda^{th}$ norm of vector s, and $\xi(x)$ is an arbitrary non-linear function of x.

12. The communication system according to claim 11, further comprising a signal output mechanism configured to wirelessly transmit a signal indicative of the separated signal.

13. The communication system according to claim 11, further comprising a signal output mechanism configured to transmit the separated signal to a speech recognition process.

14. The communication system according to claim 11, further comprising:

a speaker; and a signal output mechanism configured to transmit the separated signal to the speaker.

15. The communication system according to claim 11, wherein the communication device is a wireless headset, a wireless handset, a hands-free car kit, a telephone, or a personal data assistant.

16. A device comprising:

a processor; and a memory comprising processor readable instructions, the processor readable instructions, when executed by the processor, configure the device to:

transform multiple mixed signals into respective sets of frequency domain data, each mixed signal being a mixture of a plurality of signal sources;

receive each of the frequency domain data sets as an input to an inter-frequency dependent separation process;

adapt the an inter-frequency dependent separation process using a multivariate score function, the inter-frequency dependency being used as part of the separation process that produces separate frequency domain data associated from the input frequency domain data sets, the multivariate score function defined by the equation:

$$\varphi^{(k)}\left(\hat{s}_i^{(1)}, \ldots, \hat{s}_i^{(K)}\right) = -\frac{\psi'(\delta_\lambda(s_i))}{\psi(\delta_\lambda(s_i))} \cdot q'_\lambda(s_i) = \xi(\delta_\lambda(s_i)) \cdot \frac{s_i^{(k)}}{\delta_\lambda(s_i)}$$

$$\delta_\lambda(s_i) = \left(\sum_k \left(|s_i^{(k)} - \mu_i^{(k)}| / \sigma_i^{(k)}\right)^\lambda\right)^{1/\lambda}$$

wherein k represents a frequency bin within range 1 to K, $\phi(\bullet)$ is the score function, $s_i^k$ is the $i^{th}$ source signal for frequency bin k, $\hat{s}_i^k$ is the separated $i^{th}$ source signal for frequency k, $\psi(\bullet)$ is an arbitrary function, $\mu_i^k$ and $\sigma_i^k$ are mean and variance, respectively, of the $k^{th}$ frequency bin within $i^{th}$ signal, q' is first derivative of approximated probability density function q(s), $\delta_\lambda(s)$ is the $\lambda^{th}$ norm of vector s, and $\xi(x)$ is an arbitrary non-linear function of x; and generate a separated signal.

17. The device according to claim 16, wherein each of mixed signals is an acoustic signal generated by a transducer.

18. The device according to claim 16, where the source of each of mixed signals includes a spectral source, a data source, an image source, a physiological source, or a medical source.

19. The device according to claim 16, wherein the processor readable instructions, when executed by the processor, configures the processor to adapt the frequency dependent separation by at least preserving frequency dependencies within each signal source, but removing dependencies between signal sources.

20. A signal separation method, comprising:

sampling, using a data processing apparatus, a first input signal, which is a mixture of different signals comprising signals from at least a first signal source and a separate, second signal source, to obtain first frequency components in the first input signal;

sampling, using the data processing apparatus, a second input signal, which is a mixture of different signals comprising signals from at least the first signal source and the second signal source, to obtain second frequency components in the second input signal;

processing, at the data processing apparatus, the first frequency components and the second frequency components to extract inter-frequency dependency information between the first and the second input signals; and using, at the data processing apparatus, the extracted inter-frequency dependency information to produce separate frequency domain data from the first frequency components and the second frequency components, the separate frequency domain data corresponding to a signal originated from the first signal source and a signal originated from the second signal source, wherein to produce the separate frequency domain data a multivariate score function is used that is defined by the equation:

$$\varphi^{(k)}\left(\hat{s}_i^{(1)}, \ldots, \hat{s}_i^{(K)}\right) = -\frac{\psi'(\delta_\lambda(s_i))}{\psi(\delta_\lambda(s_i))} \cdot q'_\lambda(s_i) = \xi(\delta_\lambda(s_i)) \cdot \frac{s_i^{(k)}}{\delta_\lambda(s_i)}$$

$$\delta_\lambda(s_i) = \left(\sum_k (|s_i^{(k)} - \mu_i^{(k)}| / \sigma_i^{(k)})^\lambda\right)^{1/\lambda}$$

wherein k represents a frequency bin within range 1 to K, $\phi(\bullet)$ is the score function, $s_i^k$ is the $i^{th}$ source signal for frequency bin k, $\hat{s}_i^k$ is the separated source signal for frequency k, $\psi(\bullet)$ is an arbitrary function, $\mu_i^k$ and $\sigma_i^k$ are mean and variance, respectively, of the $k^{th}$ frequency bin within $i^{th}$ signal, q' is first derivative of approximated probability density function q(s), $\delta_\lambda(s)$ is the $\lambda^{th}$ norm of vector s, and $\xi(x)$ is an arbitrary non-linear function of x.

21. The method of claim 20, wherein the processing of the first frequency components and the second frequency components comprises:

identifying first frequency dependency between the first frequency components and the first frequency components that is related to the first signal source;

identifying second frequency dependency between the first frequency components and the first frequency components that is related to the second signal source;

using the first frequency dependency to separate a first set of selected frequency components from the first frequency components and the first frequency components;

using the second frequency dependency to separate a second set of selected frequency components from the first frequency components and the first frequency components;

processing the first set of selected frequency components to generate the signal originated from the first signal source; and processing the second set of selected frequency components to generate the signal originated from the second signal source.

22. The method of claim 21, further comprising:

applying an inverse fast Fourier transform processing in processing each of the first set of selected frequency components and the second set of selected frequency components.

23. The method of claim 20, further comprising:

applying a source prior to define expected frequency dependency information in the first and second signal sources.

24. A computer program product, encoded on a non-transitory computer-readable medium, operable to cause data processing apparatus to perform operations comprising:

transforming multiple mixed signals into respective sets of frequency domain data, each mixed signal being a mixture of a plurality of signal sources;

receiving each of the frequency domain data sets as an input to an inter-frequency dependent separation process;

adapting the inter-frequency dependent separation process using a multivariate score function, the inter-frequency dependency being used as part of the separation process to produce separate frequency domain data from the input frequency domain data sets, the multivariate score function defined by the equation:

$$\varphi^{(k)}\left(\hat{s}_i^{(1)}, \ldots, \hat{s}_i^{(K)}\right) = -\frac{\psi'(\delta_\lambda(s_i))}{\psi(\delta_\lambda(s_i))} \cdot q'_\lambda(s_i) = \xi(\delta_\lambda(s_i)) \cdot \frac{s_i^{(k)}}{\delta_\lambda(s_i)}$$

$$\delta_\lambda(s_i) = \left(\sum_k (|s_i^{(k)} - \mu_i^{(k)}| / \sigma_i^{(k)})^\lambda\right)^{1/\lambda}$$

wherein k represents a frequency bin within range 1 to K, $\phi(\bullet)$ is the score function, $s_i^k$ is the $i^{th}$ source signal for frequency bin k, $\hat{s}_i^k$ is the separated $i^{th}$ source signal for frequency k, $\psi(\bullet)$ is an arbitrary function, $\mu_i^k$ and $\sigma_i^k$ are mean and variance, respectively, of the $k^{th}$ frequency bin within $i^{th}$ signal, q' is first derivative of approximated probability density function q(s), $\delta_\lambda(s)$ is the $\lambda^{th}$ norm of vector s, and $\xi(x)$ is an arbitrary non-linear function of x; and generating a separated signal.

25. A computer program product, encoded on a non-transitory computer-readable medium, operable to cause data processing apparatus to perform operations comprising:

sampling a first input signal, which is a mixture of different signals comprising signals from at least a first signal source and a separate, second signal source, to obtain first frequency components in the first input signal;

sampling a second input signal, which is a mixture of different signals comprising signals from at least the first signal source and the second signal source, to obtain second frequency components in the second input signal;

processing the first frequency components and the second frequency components to extract inter-frequency dependency information between the first and the second input signals; and using the extracted inter-frequency dependency information to produce separate frequency domain data from the first frequency components and the second frequency components, the separate frequency domain data corresponding to a signal originated from the first signal source and a signal originated from the second signal source, wherein to produce the separate frequency domain data a multivariate score function is used that is defined by the equation:

$$\varphi^{(k)}\left(\hat{s}_i^{(1)}, \ldots, \hat{s}_i^{(K)}\right) = -\frac{\psi'(\delta_\lambda(s_i))}{\psi(\delta_\lambda(s_i))} \cdot q'_\lambda(s_i) = \xi(\delta_\lambda(s_i)) \cdot \frac{s_i^{(k)}}{\delta_\lambda(s_i)}$$

$$\delta_\lambda(s_i) = \left(\sum_k (|s_i^{(k)} - \mu_i^{(k)}| / \sigma_i^{(k)})^\lambda\right)^{1/\lambda}$$

wherein k represents a frequency bin within range 1 to K, $\phi(\bullet)$ is the score function, $s_i^k$ is the $i^{th}$ source signal for frequency bin k, $\hat{s}_i^k$ is the separated $i^{th}$ source signal for frequency k, $\psi(\bullet)$ is an arbitrary function, $\mu_i^k$ and $\sigma_i^k$ are mean and variance, respectively, of the $k^{th}$ frequency bin within $i^{th}$ signal, q' is first derivative of approximated probability density functions q(s), $\delta_\lambda(s)$ is the $\lambda^{th}$ norm of vector s, and $\xi(x)$ is an arbitrary non-linear function of x.

* * * * *